US012173424B2

(12) United States Patent
Inoue et al.

(10) Patent No.: US 12,173,424 B2
(45) Date of Patent: Dec. 24, 2024

(54) GOLD ELECTROPLATING SOLUTION

(71) Applicant: EEJA LTD., Tokyo (JP)

(72) Inventors: Koichiro Inoue, Hiratsuka (JP); Junko Tsuyuki, Hiratsuka (JP); Shinji Maeda, Hiratsuka (JP); Yusa Imanishi, Hiratsuka (JP)

(73) Assignee: EEJA LTD., Tokyo (JP)

( * ) Notice: Subject to any disclaimer, the term of this patent is extended or adjusted under 35 U.S.C. 154(b) by 0 days.

(21) Appl. No.: 18/372,302

(22) Filed: Sep. 25, 2023

(65) Prior Publication Data

US 2024/0102193 A1 Mar. 28, 2024

(30) Foreign Application Priority Data

Sep. 26, 2022 (JP) ..... 2022-152878

(51) Int. Cl.
*C25D 3/48* (2006.01)
*C25D 3/62* (2006.01)

(52) U.S. Cl.
CPC ..... *C25D 3/48* (2013.01); *C25D 3/62* (2013.01)

(58) Field of Classification Search
None
See application file for complete search history.

(56) References Cited

U.S. PATENT DOCUMENTS

| | | | | |
|---|---|---|---|---|
| 6,410,418 | B1 | 6/2002 | Yang | |
| 2004/0065225 | A1 * | 4/2004 | Ruebel | C25D 3/48 205/266 |
| 2005/0092616 | A1 | 5/2005 | Hu et al. | |
| 2015/0137356 | A1 | 5/2015 | Tsuyuki et al. | |
| 2019/0093248 | A1 | 3/2019 | Josell et al. | |

FOREIGN PATENT DOCUMENTS

| | | | |
|---|---|---|---|
| JP | H10-251887 | A | 9/1998 |
| WO | 2014-054429 | A1 | 8/2016 |

* cited by examiner

*Primary Examiner* — Wojciech Haske
(74) *Attorney, Agent, or Firm* — HAUPTMAN HAM, LLP

(57) ABSTRACT

A cyanide-free gold electroplating solution for forming gold deposits contains bismuth and compact-packed via-filling deposit with a U-shaped stacked structure in cross section inside drilled holes. A gold electroplating solution includes 15 g/L of gold (I) sodium sulfite (as gold element), 15 g/L of sodium sulfate, 50 g/L of sodium sulfite, 10 mg/L of thallium formate (as thallium element), 50 mg/L of bismuth nitrate (as bismuth element) and 1 g/L of sodium phosphate.

8 Claims, 4 Drawing Sheets

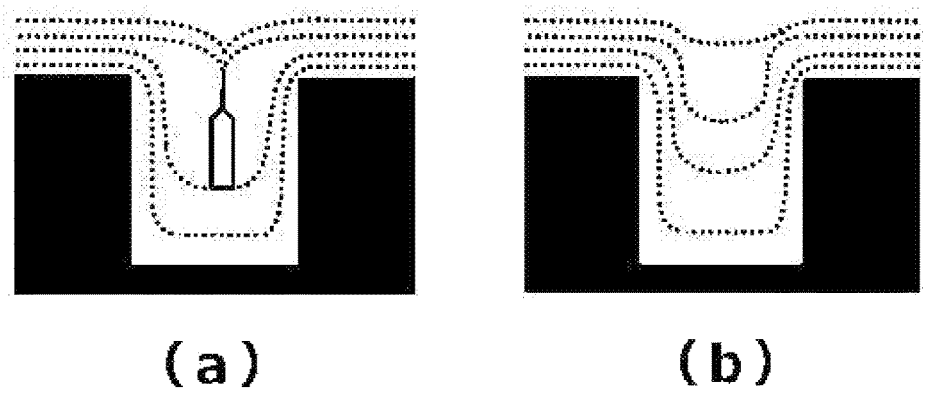
【Fig. 1】
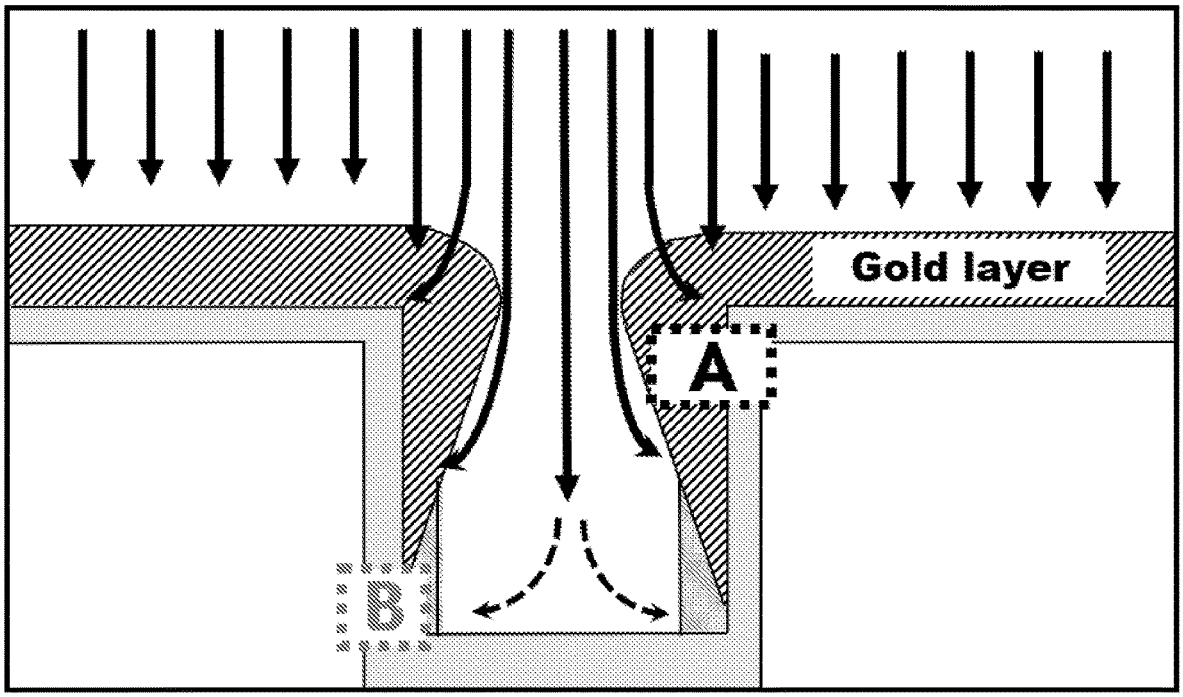
【Fig. 2】

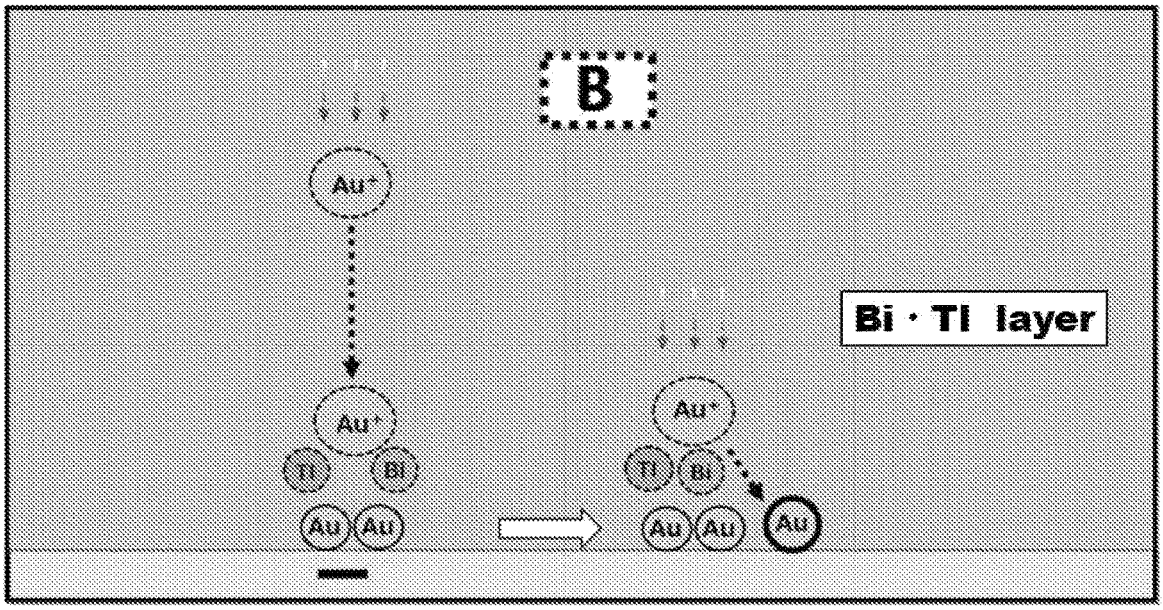
【Fig. 3】
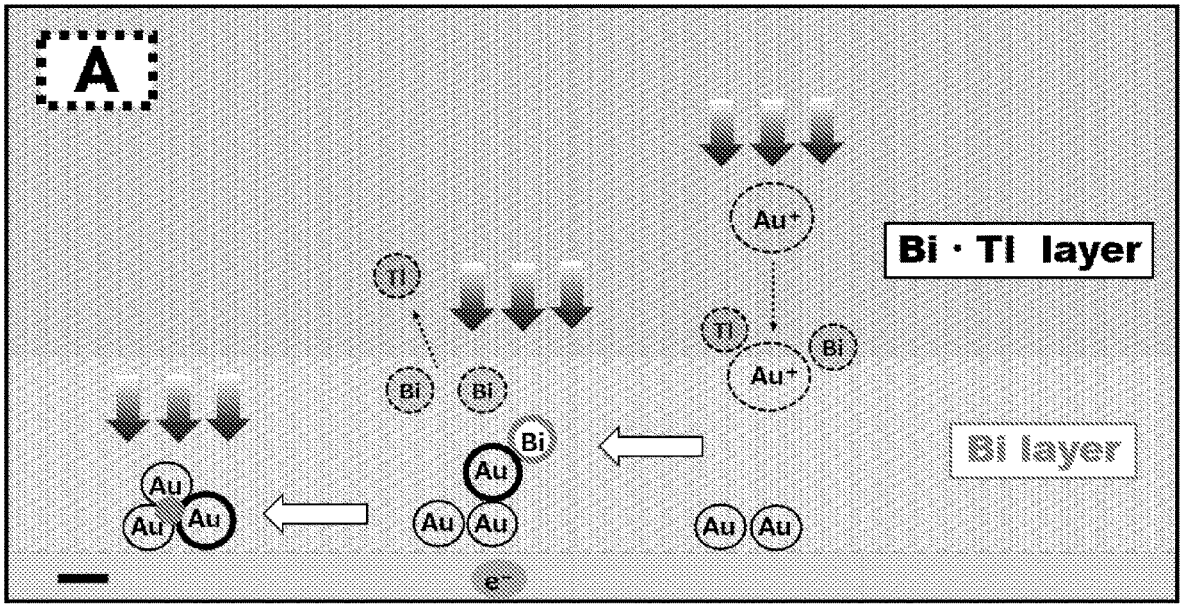
【Fig. 4】

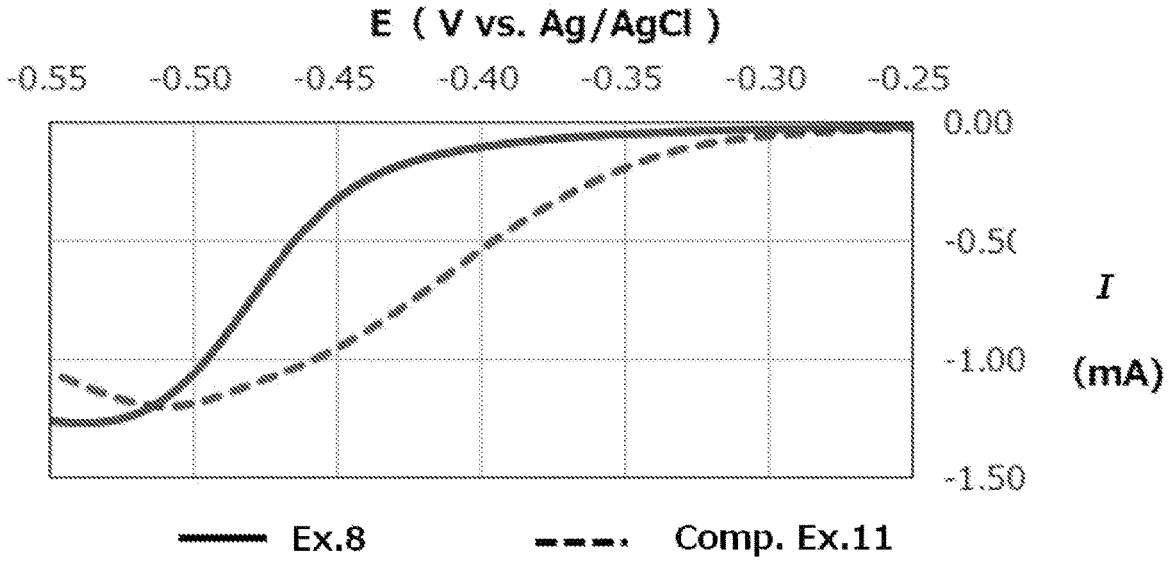
【Fig. 5】
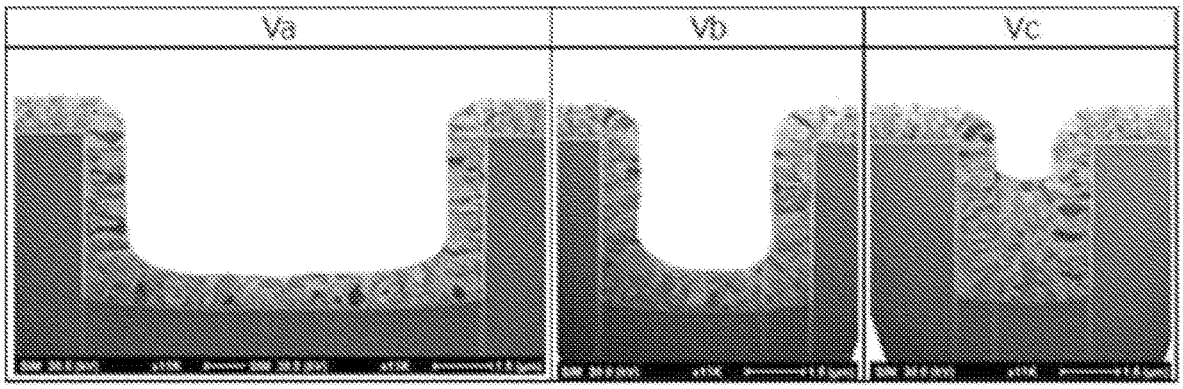
【Fig. 6】

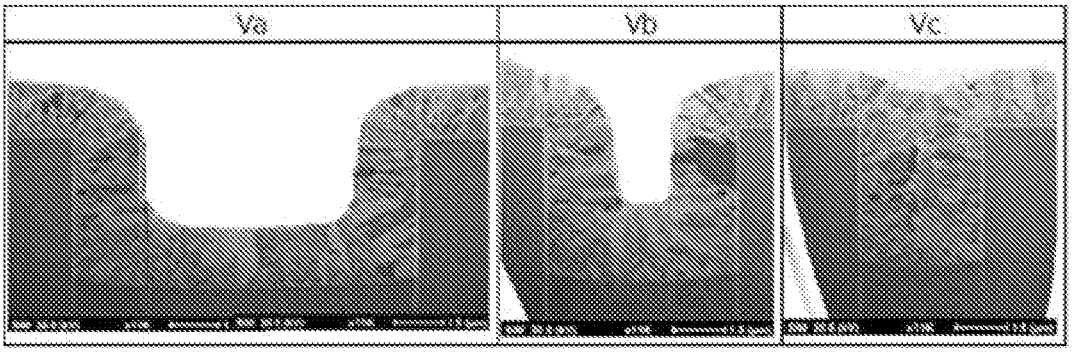
【Fig. 7】
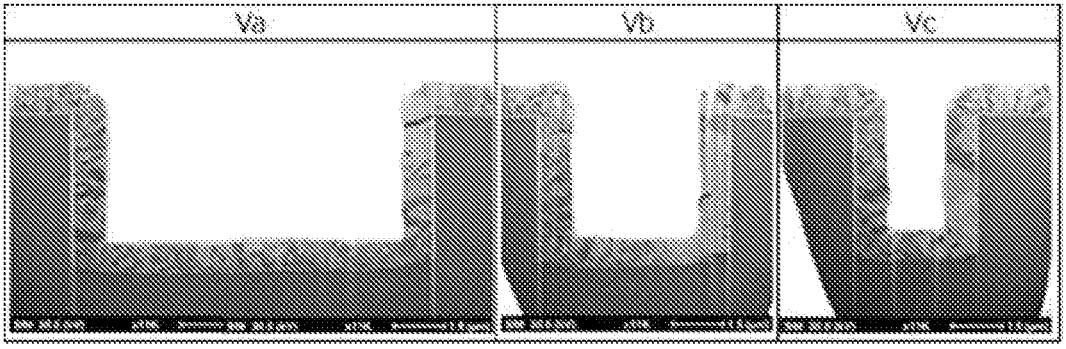
【Fig. 8】
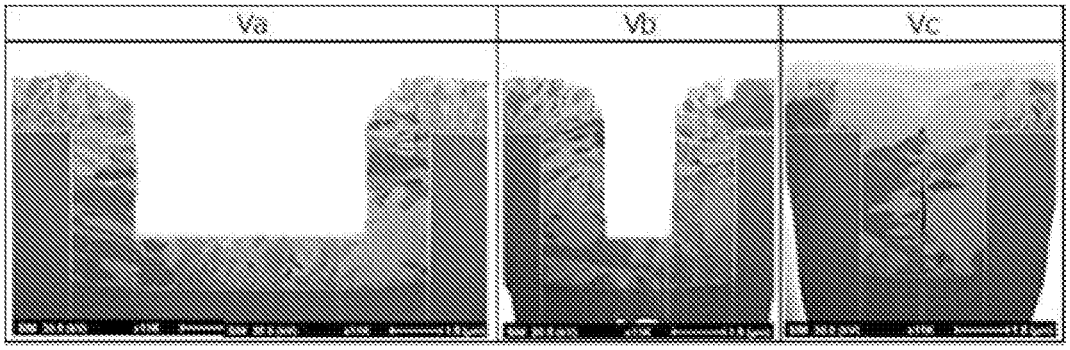
【Fig. 9】

GOLD ELECTROPLATING SOLUTION

The present non-provisional patent application claims priority, as per Paris Convention, from Japanese Patent Application No. 2022-152878 filed on 2022 Sep. 26, the disclosure of which is hereby incorporated by reference herein in its entirety.

FIELD OF THE INVENTION

This invention relates to gold electroplating solutions used in the manufacture of wiring circuits for high-density semiconductor devices or printed circuit boards or in the manufacture of semiconductor circuits, and particularly relates to gold electroplating solutions for forming void-less Via-filling (i.e., compactly packed deposit) with U shaped layer-stack structure (U shapes when seen in cross section) inside drilled holes, wherein only bismuth is contained preferentially over thallium in the gold deposit.

BACKGROUND OF TECHNOLOGY

Electrodeposition reactions with gold electroplating solutions based on gold (I) sulfite complexes and sulfates have been studied since the 1950s, and various metal crystal conditioners have been investigated to smooth the electrodeposited gold layer. For example, Japanese Patent Publication No. 10-251887 published in 1998 (hereinafter Patent Document 1) discloses a non-cyanide electro-gold plating bath containing gold sulfite salt ($Na_3[Au(S_2O_3)_2]$) and 1 to 100 g/L acetylcysteine as a complexing agent. This electro-gold bath is said to be capable of being added with known metallic elements utilized in gold cyanide electroplating baths, such as silver, copper, indium, iron, nickel, cobalt, lead, tin, cadmium, antimony, bismuth, zinc, arsenic, thallium, selenium, tellurium and cesium.

In addition, International Publication No. 2014/054429 (hereinafter Patent Document 2) reports on an alkaline non-cyanide electrolytic gold plating solution containing a crystal modifier suitable for gold bumps and gold wiring. This gold plating solution is described to contain a gold source consisting of sodium gold sulfite, a conducting salt composed of sulfite, platinum group sulfate, and a crystal modifier. Metal elements such as thallium, bismuth, lead, and antimony are said preferable for this crystal modifier, and a thallium crystal modifier is named in the examples.

On the other hand, as the density of fine conductor circuits increased in the manufacture of silicon wafer substrates for semiconductor devices and printed circuit boards, it has become necessary to provide blind via holes (sometimes called vias, grooves, or trenches) with a diameter of 1 to 50 μm and a depth of 1 to 100 μm in the middle of conductor circuits, such as printed wiring boards (PWBs) with integrated circuits and through-silicon vias (TSVs), and wafer-level packages (WLPs). Initially, a technique was developed to fill the inside of the drilled holes with conventional gold electroplating solution by pre-treating the flat surface of the substrate, which is not concave, with a non-conductive treatment, as described in U.S. Pat. No. 6,410,418 (hereinafter Document 3).

The amount of gold required to fill the interior of the drilled hole with gold electroplating usually requires a solution containing about $10^3$ times the amount of Au ions as the plating solution present in the interior. FIG. 2 schematically illustrates the current flow around the drilled hole in a cathode used in a gold electroplating process. A strong current flows uniformly on the circuit face of the drilled hole surface, while strong current is concentrated at the opening of the drilled hole. A strong current also flows into the interior of the drilled hole, but along the side walls of the drilled hole the current gradually weakens as it branches out as it progresses from the top to the bottom. At the beginning of the electrolytic deposition reaction, more Au ions are deposited on the side wall (B) located farther from the hole top, for the wall (B) is less affected by adsorption of the additive than the side wall (A) of the drilled hole near the aperture. In the electrodeposition reaction, crystal modifiers such as metal compounds exist around the Au ions as inhibitors, accelerators, or smoothing agents. The crystal modifiers also act as stabilizers to stabilize the Au ions in the gold electroplating solution.

The gold electroplating process can be detailed as follows: the direct current emitted from the anode causes the gold ions of the gold sulfite (I) complex in the gold electroplating solution and molecules such as metal salts and sulfite ions to move toward the surface of the cathode consisting of the object to be plated. In the normal gold electroplating process, Au ions are preferentially electrolyzed and deposited in the form of gold electrolyte at the stronger current density distribution in the current flow. As shown in the right-hand part in FIG. 2, Au ions are electrolytically deposited flat as Au metal on the circuit surface around the drilled holes. Although not shown in the drawing, if the opening of the drilled hole is wide and the side walls of the drilled hole are short, the hole can be filled with a uniform gold film thanks to relative uniform flow of the current. In this case, the electrolytic deposition reaction can also occur at the bottom of the drilled hole.

In a normal gold electroplating process, the current flow concentrates at the opening of the drilled hole and thus the current density distribution becomes denser there, as shown at A in FIG. 2. When the crystal modifier acts strongly enough as an inhibitor, the surface of the Au deposit is smoothened. Therefore, even when the distribution of current density becomes sparse at the opening of the drilled hole as well as at its periphery due to the fine wiring pattern on a high-density board, it is possible to obtain an Au deposit of a flat surface and a circuit with a relatively uniform thickness.

However, deeper in the drilled hole, the sparser the current density distribution becomes. Hence, if the opening of the drilled hole is narrow or the sidewalls of the drilled hole are tall, it becomes difficult for the current to flow at the bottom of the drilled hole, making it impossible to initiate an electrolytic deposition reaction there. In the area B shown in FIG. 2, although Au ions are abundantly supplied from the opening of the drilled hole, the cathode current density cannot become sufficient to cause deposition of Au. This causes deposits to accumulate at the opening of the drilled hole, resulting in voids and clefts as shown along the center line (not shown) of the drilled hole at (a) of FIG. 1.

Since the circulation of gold electroplating solution inside the drilled hole is poor, various attempts have been made to improve the flow of the solution, including mechanically shaking the object to be plated, or adding various additives such as surfactants or sulfur-containing organic substances to change the properties of the solution. However, even if Via-filling plating is performed with existing gold electroplating solutions and/or gold electroplating methods, these do not create a sufficient current flow toward the bottom sidewall at B in FIG. 2. Therefore, the problem of defects such as voids and clefts forming inside the drilled holes, as shown at (a) of FIG. 1, remained.

To solve this problem, a new gold electroplating method called super conformal filling method was proposed. For example, an example in U.S. Patent Application Publication No. 2005/0092616 (hereinafter Patent Document 4) describes a superconformal filling method in which a silicon wafer is rotated in a plating bath containing sodium mercaptopropanesulfonate and thallium and plated in pulses at periodic intervals of 2 ms on and 8 ms off (paragraphs 0053-0056, FIG. 8 in Patent Document 4).

Also, U.S. Patent Application Publication No. 2019/0093248 (hereinafter Patent Document 5) discloses a method of filling recessed features from their bottom with an electrolyte containing $Au(SO_3)_2^{3-}$ anion, $SO_3^{2-}$ anion and $Bi^{3+}$ cation. FIG. 14 of Patent Document 5 shows an image of Au deposits piling up without any void or cleft, just like a liquid accumulating in an underground tunnel (trench). FIG. 66 of the same shows an image of the inside of the through-silicon vias (TSVs) being deposited in a V-shaped cross-section when the potential is stepped while rotating the substrate. The interior of the drilled holes is super-conformally filled by this method of depositing gold deposits (paragraphs 0060 and 0070, FIGS. 14 and 56).

However, convective transport of gold electroplating solution inside the drilled hole by super-conformal filling method or stepping of potential does not control the current density distribution on the sidewall of the drilled hole. As shown at B of FIG. 2, the current flow in the bottom sidewall remains weak. In addition, the super conformal filling method has the disadvantage of making it difficult to control electroplating conditions.

When a large number of plated materials such as a large number of silicon wafers or printed circuit boards are put into a gold electroplating solution in large quantities, the electrolytic deposition conditions of individual plated materials vary greatly. In the super-conformal filling method, it is practically impossible to uniformly control the fluctuation range of plating conditions because the equipment becomes too complicated and expensive. In other words, the super-conformal filling method has the disadvantage that the plating solution tends to become unstable during the electroplating process, making it unsuitable for mass-produced products. In addition, the gold plating film of pulse-electroplated gold deposit has inferior plating film properties such as elongation and tensile strength, which also causes the inconvenience of extra costs for heat treatment in the post-process.

PRIOR ART PUBLICATIONS

Patent Documents

[Patent Document 1] Japanese Patent Application No. 10-251887

[Patent Document 2] International Publication No. 2014/054429

[Patent Document 3] U.S. Pat. No. 6,410,418

[Patent Document 4] U.S. Patent Application No. 2005/0092616

[Patent Document 5] U.S. Patent Application No. 2019/0093248

SUMMARY OF THE INVENTION

Problems the Invention Seeks to Solve

In view of the above circumstances, the present invention was made to provide a cyanide-free gold electroplating solution which produces a deposit wherein bismuth is contained preferentially over thallium in such areas where the amount of current flow has been sufficient. The inventors noticed that the reaction rate of electrolytic deposition from Au ions to gold particles differs depending on the type of metal additives in gold electroplating solution. In view of the above circumstances, the present invention was made to Via-fill, using a cyanide-free gold electroplating solution, the areas of sidewalls and the bottom of the drilled hole where electric current does not flow sufficiently. The present inventors noticed that the deposition reaction rate from Au ions to gold electrodeposits differs depending on the types of metal catalysts in cyanide-free gold electroplating solution. Due to the different reaction rates of two or more metal additives, the catalytic reaction of one metal additive becomes dominant and that of the other metal additives become inferior in the region of sufficient current flow, generating a specific catalytic inhibition reaction.

The present invention was also made to provide a gold electroplating solution with which a compactly packed Via-filling deposit with a U-shaped stacked structure (when seen in a cross-section) is obtained in the region of the drilled hole where the electric current does not flow sufficiently. The inventors found that in a gold electroplating solution with two different metal additives, the adsorption and desorption reactions of the two metal additives cooperate to produce compactly packed Via filling deposit with a U-shaped stacked structure in cross section in regions inside the drilled hole where the current does not flow sufficiently, as a result of the different reaction rates of the two metal additives.

The inventors investigated various metal compounds and found that in gold electroplating solutions based on gold (I) sulfite complexes, sulfite or sulfites, and sulfates, a metal additive combining a thallium compound and a bismuth compound is the most effective combination for mixing bismuth in the gold deposit and obtaining an optimum Via-filling result inside the holes perforated by drilling. The adsorption and desorption reactions of the bismuth and thallium catalysts occurred at the upper corners of the perforation holes, where the current density distribution was the highest. When a given amount of thallium ($Tl^{+}$) and bismuth ($Bi^{3+}$) ions coexisted, the gold deposit filling rate inside the perforation holes tended to improve as the concentration of sulfite ions ($SO_3^{2-}$) increased.

The inventors have found that when the concentration ratio of thallium ion ($Tl^{+}$) and bismuth ion ($Bi^{3+}$) in a given amount is varied, thallium, which is toxic to the human body, may or may not be entrained in the gold electrodeposit on the ppm order. We also found that in the gold electroplating solution where only bismuth is preferentially entrained in the gold deposit over thallium, the Via-filling inside the drilled hole is densely formed in a U-shaped stacked structure in cross section, leading to the completion of this invention. This specification also includes the invention of a gold electroplating method using this gold electroplating solution and a method for manufacturing this gold electroplating solution.

As is known in the electrolytic deposition reaction of the gold electroplating process using a normal DC power supply, metal additives such as thallium and bismuth compounds act as crystal modifiers to flatten the Au metal in the region where sufficient current flows. This is illustrated in A of FIG. 2. In other words, a gold electroplating solution is built up by co-adding a predetermined amount of metal additives of thallium and bismuth compounds to a basic bath adjusted with gold (I) sulfite complex, sulfate, and sulfurous acid or sulfite in a predetermined ratio. When this gold electroplating solution is used in the gold electroplating process with an ordinary DC power supply, an electrolytic deposition reaction occurs on the sidewalls of the drilled holes near the aperture.

As shown in A of FIG. 2, sulfite ions in the gold electroplating solution are also involved in the formation of the plating layer of gold deposit by electrolytic deposition reaction. As the concentration of sulfite ions increases, more sulfite ions are adsorbed on the surface of the plated object when the current is applied. The sulfite ions prevent the bismuth and thallium catalysts from approaching the cathode surface of the plated material and activate the adsorption reaction of the bismuth and thallium catalysts. The sulfate is necessary to stabilize the sulfite ions in the gold electroplating solution.

The inventors noticed that the liquid resistance of the gold electroplating solution with more bismuth catalyst content than thallium catalyst content (solid line) is different from that of the gold electroplating solution with more thallium catalyst content than bismuth catalyst content (dashed line), as shown in FIG. 5. This is discussed later in the cathodic polarization curve in FIG. 5. If the liquid resistance of the gold electroplating solution is different, the reaction rate of gold ions by the bismuth and thallium catalysts will be different when the same current is applied.

When gold electroplating work is performed using such gold electroplating solution, it was found that the inside of the drilled holes can be filled with Via-filling without voids or clefts. The inventors speculated that the different reaction rates of the bismuth and thallium catalysts, which reduce and deposit Au ions, result in the reduction and deposition of Au ions by both catalysts. The current flowing in the Au electroplating solution decreases continuously as it advances to the bottom of the perforation hole. This would create a site where cooperative adsorption/desorption reactions between bismuth catalyst activity and thallium catalyst activity occur on the side wall of the perforation hole, and this would be the starting point for the catalyst suppression reaction to spread inside the perforation hole. Comparison of Vb in FIG. 7 and the like with Vb of FIG. 9 and the like, respectively, shows that the cooperative adsorption/desorption reaction of the gold electroplating solution by the present invention is 1.5 times faster than the individual adsorption/desorption reaction of the conventional gold electroplating solution.

The compactly packed Via-filling shown at (b) of FIG. 1 is also due to the sulfite ions in the gold electroplating solution. As the concentration of sulfite ions increases, more sulfite ions are adsorbed on the surface of the plated material when the current is applied. The sulfite ions prevent the bismuth and thallium catalysts from approaching the cathode surface of the plated material, activating the adsorption reaction of the bismuth and thallium catalysts. By regulating this catalytic reaction, the interior of the drilled hole forms a compact filling deposit with a U-shaped cross section. The sulfite ions dissociated from the gold (I) sulfite complexes easily attract other gold (I) sulfite complexes. The dissociated sulfite ion groups accelerate the migration reaction of gold (I) sulfite complexes.

The bismuth and thallium catalysts adsorbed on the gold (I) sulfite complexes are repeatedly regenerated during the gold electroplating process, so that the catalyst suppression reaction of the present invention continues even if amounts of the catalysts are in trace, and thus excess Au ions are stimulated. In other words, once the catalytic deposition suppression reaction by the bismuth catalyst occurs, the Au deposit spreads to the cathode surface where the current flow is normally weak and the current density distribution is sparser. Inside the drilled hole, U-shape-layers packing (filling) as seen in cross section is compactly formed by virtue of the autonomous thallium catalytic action precipitation reaction, as shown at (b) of FIG. 1. The precipitation reaction catalytic precipitation reaction is a chemical reaction. The gold (I) sulfite complex moves into the drilled hole with the flow of electric current. Since the cooperative adsorption/desorption reaction by the bismuth and thallium catalysts occurs in the gold electroplating solution of the present invention, the reduction and deposition reaction of the gold (I) sulfite complex is faster than the adsorption/desorption reaction of bismuth or thallium individually or the electrodeposition reaction.

It is an object of the present invention to provide a gold electroplating solution that forms a flat gold plating layer of gold deposition without thallium elements. It is also an object of the present invention to provide a gold electroplating solution that forms such interior of drilled holes by dense Via-filling deposit as to have a U-shaped layered structure in cross section. It is also an object of the present invention to provide a gold electroplating solution that forms a drilled hole filled with a flat gold plating layer and dense Via-filling deposit free of thallium elements by bismuth and thallium catalysts. It is also an object of the present invention to provide a gold electroplating solution that can densely fill the interior of the drilled hole regardless of the surface morphology of the plated object and that can perform electroplating work under the same current density conditions as those of conventional flat circuit boards.

The above object of the present invention also includes providing a gold electroplating method using a gold electroplating solution that can preferentially catalytically deposit gold electrodeposits at locations where the current density distribution of the plated material is sparse and can Via-fill the internal cross section of the drilled hole in a U-shape. The above-mentioned object of the present invention also includes a gold electroplating method using gold electroplating solution in which catalytic deposition reaction by bismuth catalyst and thallium catalyst preferentially starts at the part of the drilled hole where the current density distribution is sparse, electrolytic deposition reaction preferentially starts at the part where the current density distribution is dense, both reactions are switched autonomously and gold deposits are completely Via-filling without defect. The method includes providing a gold electroplating method using a gold electroplating solution in which the gold deposits are completely filled with Via-filling without defects while both reactions are switched autonomously.

The purpose of the above gold electroplating solution also includes providing a flat gold-plated layer of gold deposits containing bismuth elements formed by the gold electroplating solution of the present invention. It also includes providing drilled holes with a U-shaped layered structure in cross section filled with compactly packed Via-filling deposit by the gold electroplating solution of the present invention. Furthermore, the invention also includes the object of providing a method for producing the gold electroplating solution described above. However, these tasks and purposes are exemplary only, and the scope of the invention is not limited thereby.

Means to Solve the Problems

A cyanide-free gold electroplating solution for forming, inside a drilled hole, a gold deposit having bismuth preferentially entrained over thallium and having a U-shape-stacked structure when seen in vertical cross section, comprising the following basic elements and additional elements, wherein, the basic elements are

| | |
|---|---|
| (a) gold (I) sulfite complex (as gold element) | 1-30 g/L |
| (b) sulfurous acid or sulfite | 5-200 g/L |
| (c) sulfate | 3-150 g/L |
| and | |
| additional elements are | |
| (d) bismuth catalyst (as elemental bismuth) | 30-150 mg/L |
| (e) thallium catalyst (as thallium element) | 5-50 mg/L |

(2) The gold electroplating solution according to the present invention is a cyanide-free gold electroplating solution for forming gold deposit containing bismuth preferentially over thallium and dense Via-filling deposit with a U-shaped stacked structure in cross section inside drilled hole, comprising the following basic elements and additional elements.

wherein, the basic elements are

| | |
|---|---|
| (a) gold (I) sulfite complex (as gold element) | 1-30 g/L |
| (b) sulfurous acid or sulfite | 5-200 g/L |
| (c) sulfate | 3-150 g/L |
| and | |
| additional elements are | |
| (d) bismuth catalyst (as bismuth element) | 30-150 mg/L |
| (e) thallium catalyst (as thallium element) | 5-50 mg/L |
| (f) a ratio of the weight of the bismuth element (d) to the weight of the thallium element (e) ((d)/(e)) of 0.6-30. | |

(3) A cyanide-free gold electroplating solution for forming gold deposits containing bismuth preferentially over thallium and dense Via-filling with a U-shaped stacked structure in cross section inside drilled holes, comprising the following basic elements and additional elements, wherein, the basic elements are,

| | |
|---|---|
| (a) gold (I) sulfite complex (as gold element) | 1-30 g/L |
| (b) sulfurous acid or sulfite | 5-200 g/L |
| (c) sulfate | 3-150 g/L |
| and | |
| additional elements are, | |
| (d) bismuth catalyst (as bismuth element) | 30-150 mg/L |
| (e) thallium catalyst (as thallium element) | 5-50 mg/L |
| and | |
| (g) 0.01 to 100 ppm of bismuth element in the gold deposit | |

(4) The gold electroplating solution according to the present invention is a cyanide-free gold electroplating solution for forming gold deposits containing bismuth preferentially over thallium and dense Via-filling with a U-shaped stacked structure in cross section inside drilled holes, comprising the following basic elements and additional elements, wherein, the basic elements are,

| | |
|---|---|
| (a) gold (I) sulfite complex (as gold element) | 1-30 g/L |
| (b) sulfurous acid or sulfite | 5-200 g/L |
| (c) sulfate | 3-150 g/L |
| and | |
| additional elements are, | |
| (d) bismuth catalyst (as bismuth element) | 30-150 mg/L |
| (e) thallium catalyst (as thallium element) | 5-50 mg/L |
| (f) a ratio of the weight of the bismuth element (d) to the weight of the thallium element (e) ((d)/(e)) of 0.6-30, | |

-continued

| | |
|---|---|
| and | |
| (g) 0.01-100 ppm of the bismuth element in the gold deposit | |

The following embodiments also form part of the gold electroplating solution according to the present invention.

(5) In any of (1) to (4), the gold electroplating solution according to the present invention further contains 35 to 140 mg/L of (d) bismuth catalyst (as bismuth element) and 6 to 45 mg/L of (e) thallium catalyst (as thallium element).

(6) In any of (1) to (4), the gold electroplating solution according to the present invention also has the following additional component (h).

(h) The weight ratio ((d+e)/(b)) of the total amount of said bismuth element (d) and said thallium element (e) to the weight of said sulfite or sulfite (b) is $1.4\times10^{-4}$ to $400\times10^{-4}$.

(7) In any of (1) to (4), the gold electroplating solution according to the present invention, (e) the thallium catalyst is one or more of thallium formate, thallium sulfate, thallium nitrate, thallium carbonate, thallium oxide, thallium bromide, thallium acetate and thallium malonate and (d) the bismuth catalyst is one or more of bismuth nitrate, bismuth sulfamate, bismuth phosphate, bismuth diphosphate, bismuth acetate, bismuth citrate, bismuth phosphonate, bismuth carbonate, bismuth oxide, and bismuth hydroxide.

(8) In (3) or (4), the gold electroplating solution according to the present invention may further have the following feature (j).

(j) Thallium element in gold deposit is less than 0.1 ppm.

Here, in the range of gold (I) sulfite complexes in (1) through (4), (a) above, the lower limit value of 3 g/L or more as gold (Au) element is preferred to form a stable gold plating film. On the other hand, the upper limit value of 30 g/L or less is preferred because gold bullion is expensive and the amount of pumping out due to adhesion of the solution to the material to be plated increases. The content of thallium element in the Via-filling in (3) and (4) above should be relatively close to zero compared to the content of bismuth element. The ratio of both catalyst elements (thallium element content/bismuth element content) in the gold deposit should be at least ⅓, preferably 1/10 or greater, more preferably 1/100 or greater, or even more preferably 1/1,000 or greater.

In any of (1) to (4), regarding (d) the bismuth catalysts, its lower limit is 30 mg/L, and 35 mg/L is preferred. The upper limit of the bismuth element is 150 mg/L, and 140 mg/L is preferred. In any of (1) to (4), regarding (e) the thallium catalysts, its lower limit is 5 mg/L, and 6 mg/L is preferred. Its upper limit is 50 mg/L, and 45 mg/L is preferred. The upper and lower limits of the bismuth and thallium elements are determined to secure that the bismuth element in the gold deposit becomes in the range of 0.01 to 100 ppm.

It is also preferred that said (d) bismuth catalyst is one or more of bismuth nitrate, ammonium bismuth citrate and bismuth sulfamate, and said (e) thallium catalyst is one or more of thallium formate, thallium malonate and thallium nitrate. It is particularly preferred that said (d) bismuth catalyst is bismuth nitrate and said (e) thallium catalyst is thallium formate.

The inventions of the gold electroplating solution according to any of the above (1) through (8) are all exemplified by the invention of a gold electroplating method in which a gold electroplating solution based on gold (I) sulfite complex, sulfate and sulfite or sulfite is co-added with trace amounts of bismuth and thallium compounds to electroplate the inside of the drilled hole to obtain a U-shaped stacked structure, as seen in cross section.

In addition, any of the inventions of gold electroplating solution according to any of the above (1) to (8) discloses the invention of a gold electroplating method for densely Via-filling the inside of a number of drilled holes using this gold electroplating solution. In addition, any of the inventions of gold electroplating solution according to any of the above (1) to (8) discloses an invention of a gold electroplating method in which bismuth element is more involved than thallium element in the gold deposit using this gold electroplating solution.

Furthermore, any of the inventions of gold electroplating solution according to any of the above (1) to (8) discloses the invention of a flat gold plating layer of gold deposit containing only bismuth preferentially over thallium, which is formed by this gold electroplating solution. Moreover, any of the inventions of gold electroplating solution according to (1) to (8) above all disclose the invention of a U-shaped layered structure in cross section filled with dense Via-filling formed inside a drilled hole by this gold electroplating solution. Furthermore, any of the inventions of gold electroplating solution according to (1) through (8) above also includes providing a method for manufacturing the above gold electroplating solution.

For example, the gold electroplating solution of (1) above discloses the invention of a gold electroplating method for Via-filling the inside of a drilled hole in a U-shape using the gold electroplating solution of (1) above, as shown in the examples, etc. described below. Also disclosed is the invention of a flat gold plating layer of gold electrodeposits formed by using the gold electroplating solution of (1) above, in which more than 0.01 ppm of the bismuth element is entrained and less than 0.1 ppm or preferably less than 0.01 ppm of the thallium element is entrained. These disclosed inventions of gold electroplating methods constitute herein an invention separate from the invention of gold electroplating solution.

In particular, the invention of the following gold electroplating method in which a direct current is applied is disclosed in the invention of the gold electroplating solution.

(9) The gold electroplating method according to the present invention using any of the gold electroplating solutions from (1) to (8) is to electroplate the interior of the flat circuit and drilled holes of the plated object by applying a direct current.

The following embodiments also form part of the gold electroplating method according to the present invention.

(10) In (9), the gold electroplating method according to the present invention has a current density of 0.03-0.6 A/dm$^2$ for the plated material.

(11) In (9), the gold electroplating method according to the present invention has a current density of 0.1-1.0 A/dm$^2$ for the plated material.

(12) In (9), the gold electroplating method according to the present invention requires that the substrate of the plated object has a gold or palladium film formed in advance. These films should be dry plating films such as vacuum deposited film or magnetron sputtered film.

Effects of the Invention

The gold electroplating solution of the present invention is able to completely and defect-freely Via-fill drilled holes with electrodeposit, even inside high aspect ratio drilled holes where the current flow does not reach. Moreover, as a result of the adjustment of the content of the bismuth and thallium elements in the gold electroplating solution, the gold deposit electroplated by the electrolytic deposition reaction has the unique phenomenon of containing no thallium element, which is harmful to the human body, although bismuth is preferentially contained in the electroplated gold deposit. Thallium elements are highly toxic and no more than 0.1 ppm of them should be detected in the gold plating layer in printed wiring circuits.

When the cross section of the drilled hole was observed, it was found that the gold electroplating solution of the present invention deposits gold electrodeposit which has a U-shaped cross section. In high-aspect-ratio drilled holes, a U-shaped structure with a hemispherical cross section is compactly deposited from the center of the aperture. The gold electroplating solution of the present invention has the specific effect of causing the depositing gold deposits to have a U-shape in cross section even in a deeper section of the drilled hole where the current density distribution is the sparser. In other words, the gold electroplating solution of the present invention can constantly create a compact Via-filling having a U-shaped cross section even at such depths of a drilled hole where the current flow fails to reach.

The gold electroplating solution of the present invention is an improvement of gold electroplating solution with two types of metal additives. It is known that the effect of metal additives to gold electroplating solution is to provide excellent liquid stability and to help obtain uniform plating thickness on the flat circuit surface of the plated object, even with wide and narrow complex line widths. The gold electroplating solution of the present invention also possesses these known effects.

However, the specific effect of this invention has not been known with regard to conventional gold electroplating solutions containing metal additives. Namely, conventional gold electroplating solutions could not help produce compactly packed Via-fill plating in places where the current flow was insufficient, such as at B of FIG. 2.

Furthermore, the above effects of the gold electroplating solution of the present invention extend to the invention of a gold electroplating method for electroplating the inside of drilled holes by adding trace amounts of thallium and bismuth compounds to a gold electroplating solution based on gold (I) sulfite complex, sulfate and sulfurous acid or sulfite. The above effects of the gold electroplating solution also extend to the invention of a gold electroplating method for Via-filling inside a number of drilled holes using the gold electroplating solution of the present invention.

The above effects of the gold electroplating solution of the present invention also extend to the invention of the method of manufacturing the gold electroplating solution of the present invention. In other words, the gold electroplating solution of the present invention can achieve the above effects by manufacturing a gold electroplating solution having the prescribed composition of components. The specific effects of the gold electroplating solution of the present invention also extend to the invention of dense Via-filling deposit with a U-shaped stacked structure in cross section inside drilled holes, which are filled inside a number of drilled holes using the gold electroplating solution of the present invention, and to the invention of gold deposits containing bismuth in preference to thallium.

The gold electroplating method according to the present invention has the effect that even if the aspect ratio of the drilled hole differs and the current density distribution on the deposition surface on the plated object changes, a compact Via-filling with a U-shaped cross section is always formed inside the drilled hole by virtue of the coordinated adsorption/desorption reaction by both catalysts, as shown in FIG. 3. According to the gold electroplating method of the present invention, in a smooth gold-plated film, where plating rate is fast, i.e., where the amount of gold ions consumed per time on the surface of the plated object is high, the bismuth element is entrained in the gold-plated deposit because the bismuth catalyst adsorbed on the surface cannot be desorbed. However, because of the limited reduction and deposition rate of the deposit, the amount of bismuth involved can be kept in the range of 100 ppm at maximum. However, because of the limited reduction and deposition rate of the deposit, the amount of bismuth entrained can be kept in the range of 100 ppm at maximum.

Furthermore, according to the gold electroplating method of the present invention, the grain structure of the compactly-packed deposit inside the drilled hole has a metallurgical thermal recovery effect. This does not require any special heat treatment. The gold purity of gold deposits produced by electroplating operations using the gold electroplating solution is 99.99% or higher. This is because such pure gold electrodeposits are metallurgically self-healing by thermal energy, such as in subsequent gold plating operations.

According to the gold electroplating method of the present invention, the following effects are achieved in addition to the effects of the gold electroplating solution of the present invention described above.

In other words, the gold electroplating method of the present invention is effective in densely filling the inside of through-silicon wafer vias (TSV) and blind via holes of copper-clad laminates with gold deposits by simply applying an ordinary DC current without using a complicated pulse power supply. Via-filling of TSVs and blind via-holes in copper clad laminates with gold deposits is possible. In addition, the gold electroplating method of the present invention has the effect that long-term stable gold electroplating work can be continuously performed by simply replenishing consumed sulfurous acid or sulfite and gold sulfite, without replenishing bismuth catalyst and thallium catalyst. The gold electroplating method also has the effect that the catalyst suppression reaction in the gold electroplating solution does not fluctuate even if the Via-filling is repeated many times.

BRIEF EXPLANATION OF DRAWINGS

FIG. 1 shows schematic diagrams of Via-filling results (a) and (b).

FIG. 2 is a schematic diagram of current flow in electroplating solution.

FIG. 3 is a schematic diagram of an invented electroplating solution inside a drilled hole.

FIG. 4 is a schematic diagram of an invented electroplating solution at the periphery of the drilled hole.

FIG. 5 is cathodic polarization curves according to Example 9 of the invention and Comparative Example 11.

FIG. 6 is cross-sectional views of drilled holes of Example 10 of the invention.

FIG. 7 is cross-sectional views of drilled holes of Example 11 of the invention.

FIG. 8 is cross-sectional views of drilled holes of Comparative Example 13.

FIG. 9 is cross-sectional views of drilled holes of Comparative Example 14.

EMBODIMENTS OF THE INVENTION

Described hereinunder is the description of each embodiment of the invention. The gold electroplating solution of one embodiment of the present invention is a gold electroplating solution containing mainly gold ions derived from gold (I) sulfite complexes, predetermined amounts of bismuth and thallium catalysts, and sulfite ions in a specified ratio. The gold electroplating method of one embodiment of the present invention is a gold electroplating method for Via-filling the interior of a drilled hole using a gold electroplating solution chiefly comprising the sulfite ions and such predetermined amounts of bismuth catalyst and thallium catalyst that they cause desirable coordinated adsorption and desorption reaction.

The invention will now be illustrated in drawings. FIG. 3 schematically shows the cooperative adsorption and desorption reactions inside the drilled hole shown at (b) of FIG. 1. FIG. 4 illustrates the main mechanism of gold deposit inside the drilled hole. The sulfite ions are omitted. The area B in FIG. 2 is where the current flow is weak and hence it is difficult for the Au ions to electrodeposit on the Au metal. Here, the electrical energy applied to the Au ions is low, so the bismuth or thallium catalyst is not entrapped in the gold deposit. Even if the current flow is weak, Au ions are supplied in large quantities through the openings of the perforation holes, so there is no shortage of Au ions.

As shown in FIG. 3, one bismuth catalyst acts on one gold (I) sulfite complex at one site on the cathode. One thallium catalyst acts on this bismuth catalyst, causing catalyst-promoted reactions through coordinated adsorption and desorption reactions. This adsorption/desorption action of both bismuth catalysts fills the gold deposit so that it spreads inside the perforation hole. When the concentrations of both catalysts are moderately adjusted, the inside of the drilled hole can be densely filled, resulting in a Via-filling with a U-shaped stacked structure in cross section, as shown at (b) of FIG. 1.

FIG. 4 schematically shows the mechanism of electrodeposition reaction and its product at the area where the current flow is strong (A in FIG. 2). FIG. 4 illustrates the main mechanism of gold deposit at the periphery of the drilled hole. The sulfite ion group is omitted. In the area indicated by (a) in FIG. 2, the electrolytic deposition reaction in normal electroplating operation occurs because the current flow is strong. By adjusting the content of bismuth and thallium catalysts, it was found that there is a range where bismuth elements are detected in the electrodeposited gold plating film but thallium elements are not detected. This is one of the specific effects of the present invention obtained by adjusting the content of bismuth and thallium elements in the gold electroplating solution.

FIG. 4 shows how the bismuth catalyst becomes dominant in the Au electroplating solution, forming a bismuth-enriched layer, and how the bismuth catalyst is involved in the electrolytic deposition reaction of Au ions. It was found that by controlling the electrodeposition reaction through adjustment of the contents of both catalyst metals in the gold electroplating solution, it becomes possible to adjust the amounts of the bismuth element and thallium element in the resultant gold deposit. Therefore, as shown in FIG. 4, if a bismuth-enriched layer of a certain thickness is formed in the gold electroplating solution, only the bismuth element can be detected in the gold deposit and the entrapment of the thallium element can be avoided.

The drawing on the right side of FIG. 4 shows how Au ions rush into the bismuth concentrated layer due to the strong current flow in the Au-electroplating solution. This is because there is only bismuth catalyst in the bismuth-enriched layer, so the bismuth catalyst tends to co-deposit when Au ions are deposited, and the bismuth catalyst is entrained in the Au electrodeposit. The middle drawing in FIG. 4 shows how the bismuth-enriched layer has a barrier effect on the thallium catalyst. The thallium catalyst stays in the gold electroplating solution above. As shown in the left side drawing in FIG. 4, when Au ions are electrodeposited to Au metal, the bismuth catalyst is also entrained into the gold electrodeposit together. The electrodeposited bismuth metal is trapped in the subsequent electrodeposited gold deposit and cannot be redissolved in the gold electroplating solution.

By varying the concentration of the bismuth and thallium elements in the gold electroplating solution, it is possible to make the thallium component be detected relatively more in the electrolytically deposited gold plating layer than the bismuth component. For example, if the concentration of the bismuth element is relatively thin or the concentration of the thallium element is relatively high, the thallium catalyst is preferentially adsorbed and desorbed, and the thallium component is easily entrained in the gold deposit.

FIG. 4 shows that when thallium catalyst becomes dominant in the Au electroplating solution, a thallium enriched layer is formed and the thallium catalyst may be entrained into the Au deposit. In other words, once the preferential reaction of the bismuth or thallium catalyst is initiated, the deposition reaction of Au ions proceeds toward the bismuth or thallium catalyst that is more likely to occur.

As the Via-filling by the present invention progresses, the space in the perforation hole becomes shallower and the current density distribution inside and above the perforation hole becomes equal, and the bismuth catalyst becomes less active. Then, the existing electrodeposition reaction will dominate instead of the cooperative adsorption/desorption reaction. Precise measurement of the thickness (per unit time) of the Via-filled gold deposit in the case of (b) of FIG. 1 may provide information on the rate of coordinated adsorption/desorption and electrodeposition reactions in the gold electroplating solution.

In this document, thallium ions (metal) and bismuth ions (metal) in the cooperative adsorption/desorption and catalytic deposition reactions of thallium ions (metal) and bismuth ions (metal) in gold electroplating solutions and methods, or in electrolytic deposition reactions, are herein conveniently called "thallium catalyst" and Bismuth catalyst". In other words, in the gold plating solution according to the present invention, a certain amount of bismuth catalyst and thallium catalyst not only act as a crystal modifier in the electrodeposition reaction where the cathodic current density is high, but also show a catalytic inhibition reaction of thallium catalyst. The bismuth and thallium catalysts have a cooperative catalytic action that repeatedly adsorbs and desorbs to the plated object surface inside the perforated hole through a barrier layer of sulfite ion groups in the catalytic deposition reaction with weak cathodic current density. In this document, for the sake of convenience, the term "electrodeposition reaction" is used at the perimeter of the perforated hole shown in A of FIG. 2, and "catalytic deposition reaction" or "cooperative adsorption/desorption reaction" inside the perforated hole shown in B of FIG. 2, to distinguish the electrodeposited gold plating film.

"Via-filling" is a plating technique in which the interior of the drilled hole is filled with a layered, stacked structure. This is especially the bottom of the drilled hole and its periphery. The gold electroplating solution of the present invention can preferentially deposit and fill plated areas such as these through a coordinated adsorption and desorption reaction.

By using the gold electroplating solution of the present invention, it is possible to obtain Via-filling deposits that are compactly-packed inside plating of the drilled holes. In the present invention, the cross-sectional shape of the densely filled Via-filling deposit is not limited to rectangular. It can be barrel-shaped or inverted barrel-shaped, trapezoidal or inverted trapezoidal. This is because even the shape of the drilled hole, which normally does not allow current flow, can be densely filled by the catalytic inhibition reaction of the present invention.

Gold Electroplating Solution

Oxygen from the atmosphere is taken into the gold electroplating solution before the electroplating process starts, and it exists as dissolved oxygen in the gold electroplating solution. When the dissolved oxygen reacts with the gold (I) sulfite complex, the gold complex is decomposed and gold particles are deposited. However, when excess sulfite ions coexist in the gold electroplating solution, the dissolved oxygen reacts with the sulfite ions before the gold (I) sulfite complex to form sulfate ions. In the gold electroplating solution, bismuth ions ($Bi^{3+}$) and thallium ions ($Tl^{+}$) also act autonomously as existing crystal conditioners. As a result, the gold (I) sulfite complex can exist stably in the gold electroplating solution without decomposition. In other words, the gold electroplating solution of the present invention is liquid stable. The gold electroplating solution of the present invention is stable before and after electroplating operations.

The gold electroplating solution of the present invention can form a compactly packed Via-filling with a U-shaped stacked structure in the cross section inside the drilled hole where the current flow is weak, and even if the current density distribution of the plated material is coarse or dense, the catalyst suppression reaction and electrolytic deposition reaction can switch over autonomously. In the gold electroplating solution of the present invention, bismuth ion ($Bi^{3+}$) and thallium ion ($Tl^{+}$) also have the effect of acting autonomously as catalysts or existing crystal conditioners.

Gold (I) Sulfite Complex

The content of gold (I) sulfite complex in gold electroplating solution for the present invention can be determined according to the electroplating workload, as with conventional gold electroplating solutions. Gold (I) sulfite complexes can be made from one or more gold (I) sulfite alkali metals, such as gold (I) sodium sulfite, gold (I) potassium sulfite, gold (I) ammonium sulfite, gold (I) ethylammonium sulfite, gold (I) dimethylammonium sulfite, gold (I) diethylammonium sulfite, gold (I) trimethylammonium sulfite, or gold (I) triethylammonium sulfite.

Sulfite Ion

In the gold electroplating solution and gold electroplating method for the present invention, sulfite or sulfite is a group of sulfite ions that stabilize the gold electroplating solution. In other words, aqueous solutions containing sulfite or sulfite protect gold (I) sulfite complexes by converting dissolved oxygen into sulfate ions. Dissolved oxygen generated during the electroplating process is also converted to sulfate ions. Therefore, the gold sulfite (I) complex in the gold electroplating solution does not decompose and a stable gold complex gold electroplating solution can be obtained. In addition, an increase in the concentration of sulfurous acid or sulfite has the effect of accelerating the deposition rate of gold electrodeposits inside the drilled holes.

The present invention requires 5 to 200 g/L of sulfite. If the sulfite is less than 5 g/L, the gold (I) sulfite complex decomposes in the gold electroplating solution and colloidal gold particles are easily formed. When sulfite exceeds 200 g/L, colloidal gold particles are more likely to form. This is because dithionite ions may be formed. The preferred content of sulfite is 20 to 150 g/L. The more preferred content of sulfite is from 30 to 100 g/L. The particularly preferred content of sulfite is 40-60 g/L.

In addition, 3 to 150 g/L of sulfate is required in the present invention. Sulfate is necessary to stabilize the sulfite ion group in the gold electroplating solution. If the sulfate content is less than 3 g/L, the sulfite group tends to decompose during gold electroplating, making it difficult for the sulfite group to act as a barrier agent. If the sulfate content exceeds 150 g/L, sulfate crystals may precipitate in the gold electroplating solution. The preferred content of sulfate is 5 to 100 g/L. The more preferred content of sulfate is 10 to 50 g/L. Particularly preferred sulfate content is 15 to 30 g/L.

Bismuth Catalyst

Bismuth catalysts in the gold electroplating solution and gold electroplating method can be selected from known ones useful for gold electroplating solution. Such include but not limited to bismuth alkane sulfonate salts, e.g., bismuth methanesulfonate, bismuth ethanesulfonate, bismuth propanesulfonate, 2-bismuth propanesulfonate, and bismuth p-phenol sulfonate, Bismuth alkanol sulfonate salts, e.g., bismuth hydroxymethanesulfonate, bismuth 2-hydroxyethane-1-sulfonate, and bismuth 2-hydroxybutane-1-sulfonate, bismuth gluconate, and bismuth lactate, as well as inorganic bismuth salts, such as bismuth oxide, bismuth hydroxide, bismuth carbonate, bismuth trifluoride, bismuth bromide, bismuth nitrate, bismuth sulfate, bismuth pyrophosphate and bismuth chloride. Water-soluble bismuth compounds (e.g., aqueous bismuth hydrochloride, bismuth nitrate, bismuth sulfamate, bismuth phosphate, bismuth diphosphate, bismuth acetate, bismuth citrate, bismuth phosphonate, bismuth carbonate, bismuth oxide, bismuth hydroxide) are preferred bismuth catalysts. Bismuth nitrate, bismuth ammonium citrate and bismuth sulfamate are particularly preferred.

The content of bismuth catalyst must be 30 to 150 mg/L in terms of bismuth element. This range prevents the thallium element from entering the gold deposit. At least 30 mg/L is required as the lower limit of the bismuth element, and 35 mg/L is preferred. The upper limit of the bismuth element is 150 mg/L, and 140 mg/L is allowable. In other words, the preferred content of bismuth catalyst is 35 to 140 mg/L.

Thallium Catalyst

Thallium catalysts required for the gold electroplating solution and gold electroplating method of the present invention include sulfates, acetates, nitrates, sulfides, chlorides, borosilicates, and other organic salts. The thallium catalyst can be either primary or secondary thallium as long as it is a soluble salt. The thallium catalyst is not entrapped in the gold deposit in the gold electroplating solution according to the composition of the components of the present invention. Preferred thallium catalysts are thallium formate, thallium sulfate, thallium nitrate, thallium carbonate, thallium oxide, thallium bromide, thallium acetate, and thallium malonate. Thallium formate, thallium malonate and thallium nitrate are especially preferred.

The thallium catalyst content requires 5-50 mg/L of thallium element. If the thallium catalyst content exceeds 50 mg/L, the thallium element may be included in the gold deposit due to coordination with the bismuth catalyst content. The upper limit of thallium element is 50 mg/L, and 45 mg/L is preferred. If the lower limit of thallium catalyst is less than 5 mg/L, it may be difficult to deposit fine gold deposits inside the depressions. The lower limit of thallium element is 5 mg/L, and 6 mg/L is preferred. In other words, the preferred content of thallium catalyst is 6-45 mg/L.

Others

The weight ratio of the bismuth catalyst to the thallium catalyst (bismuth element/thallium element) of 0.6 to 30 is preferred. Within this ratio range, the catalytic inhibition reaction from gold (I) sulfite complex ($[Au(SO_3)^{2-}]^{3-}$) to gold (Au) is further promoted by the following reaction equations (1) and (2).

$$Au(SO_3)_2^{3-} \rightarrow Au^+ + 2SO_3^{2-} \quad (1)$$

$$Au^+ + e \rightarrow Au \quad (2)$$

A lower limit of 0.6 for the ratio of bismuth catalyst to the thallium catalyst may cause coarse gold to deposit inside the concaves. If this ratio exceeds the upper limit of 30, voids and cavities may form on the walls and inside of the concaves. The ratio of the bismuth catalyst to the thallium catalyst is preferably greater than 1 but 30 or less. A more preferred ratio is from 3 to 25, even more preferably from 5.0 to 20, and a particularly preferred ratio is from 7.0 to 15. The weight ratio of the total amount of the above bismuth catalyst (D) and the above thallium catalyst (C) to the weight of the above sulfite or sulfite (A) was examined, and the range of $1.4\times10^{-4}$ to $400\times10^{-4}$ is preferred.

Furthermore, the conducting salts other than sulfates and sulfurous acid or sulfites (collectively referred to as "interferents") required for the gold electroplating solution and gold electroplating method of the present invention are electro-conducting salts and complexing agents. Typical examples are additives commonly added to gold electroplating solutions. These conducting salts can also include pH adjusters (buffers) and masking agents. Conducting salts can be added to the extent that they do not interfere with the formation of the cross-sectional U-shaped deposition structure.

One type of conducting salt may be used alone or in combination with two or more types. Possible conducting salts include inorganic salts such as halides, nitrates, carbonates, and phosphates, and organic salts such as acetates, oxalates, citrates, and carboxylates. Preferable choices are halide, nitrate, carbonate, phosphate, acetate, oxalate or citrate. More preferably carbonate, phosphate, acetate or oxalate.

Conducting salts improve the coarseness of the current density distribution in gold electroplating solution. Therefore, the addition of conducting salts to the gold electroplating solution of the present invention promotes the normal electrolytic deposition reaction in gold electrodeposits on the one hand, and inhibits the catalytic inhibition reaction on the other hand. However, if too much conductive salt is added, as shown at (a) of FIG. 1, voids or other defects are likely to form in the gold deposit. The fewer the conducting salts in the gold electroplating solution of the present invention, the more desirable it is. This is because the catalytic inhibition reaction of the present invention becomes less affected. The range of content of the conductive salt is preferably from 0.01 to 9% of the content of the disturbing agent. More preferably it is in the range of 0.1 to 9%, even more preferably in the range of 0.1 to 8%, and especially preferably 0.5 to 5%.

The pH range in the gold electroplating solution of the present invention is preferably between 6 and 13. The gold (I) sulfite complexes tend to become unstable when the pH is below 6. On the other hand, if the pH exceeds 13, masking agents such as photoresist may be dissolved. pH in the range of 7 to 12 is more preferable.

The current density in the gold electroplating method of the present invention is preferably in the range of 0.03-0.6 $A/m^2$ using DC current; if the current density exceeds 0.6 $A/m^2$, cavities are likely to form inside the drilled holes. If the current density is less than 0.03 $A/m^2$, the interior of the drilled hole may not be electroplated. In the case of jet stream plating, the current density should be in the range of 0.1 to 1.0 $A/dm^2$. Jet stream plating method is highly desirable for mass production.

In the gold electroplating solution of the present invention and gold electroplating method thereof, the plated object can be a metal-coated wiring circuit such as semiconductor wafers, ceramic wafers and printed circuit boards. Typical semiconductor and ceramic wafers are Si and GaAs substrates. Printed circuit boards can be copper clad laminates, etc. The underlying metal coating inside the drilled holes preferably consists of a gold film. The drilled holes preferably have an opening area of 1 to 50 μm in terms of the diameter of the opening, and an aspect ratio of 0.8 to 2.0.

EXAMPLES

The following examples will illustrate the invention in detail. Gold electroplating solutions (01) to (08) were prepared with the compositions described below. These eight gold electroplating solutions correspond to Examples 1-8.

Stability of Gold Electroplating Solution

Example 1

The gold electroplating solution (01) in Example 1 contained the following compositions A through F, while pH=8.0.

| | |
|---|---|
| A: sodium gold (I) sulfite (as gold element) | 15 g/L |
| B: sodium sulfite | 50 g/L |
| C: sodium sulfate | 15 g/L |
| D: thallium formate (as thallium element) | 10 mg/L |
| E: bismuth nitrate (as bismuth element) | 50 mg/L |
| F: sodium phosphate | 1 g/L |

Here, the weight ratio of both catalysts (D: thallium formate, and E: bismuth nitrate combined) to the barrier agent (B: sodium sulfite), i.e., both catalysts (Bi+Tl)/barrier agent ($Na_2SO_3$), was $12\times10^{-4}$. The weight percentage of the conductive salt (F: sodium phosphate) to the interfering agent (the sum of B: sodium sulfite and C: sodium sulfate), i.e., conductive salt ($Na_3PO_4$)/interfering agent ($Na_2SO_3$+$Na_2SO_4$) was 1.5%. The plating solution was stable before and after the electroplating operation, and no gold precipitates were observed after the electroplating operation was completed.

Example 2

The gold electroplating solution (02) in Example 2 contained the composition of components A through F below, while pH=12.0.

| | |
|---|---|
| A: sodium gold (I) sulfite (as gold element) | 15 g/L |
| B: sodium sulfite | 65 g/L |
| C: sodium sulfate | 30 g/L |
| D: thallium formate (as thallium element) | 20 mg/L |
| E: bismuth nitrate (as bismuth element) | 70 mg/L |
| F: sodium nitrate | 5 g/L |

Here, the weight ratio of both catalysts (D: thallium formate and E: bismuth nitrate combined) to the barrier agent (B: sodium sulfite), i.e., both catalysts (Bi+Tl)/barrier agent ($Na_2SO_3$) is $14\times10^{-4}$. The weight ratio of thallium catalyst to bismuth catalyst, i.e., (Bi)/(Tl), is 3.5. The weight ratio of the conducting salt (F: sodium nitrate) to the disturbing agent (the sum of B: sodium sulfite and C: sodium sulfate), i.e., conducting salt ($NaNO_3$)/disturbing agent ($Na_2SO_3$+$Na_2SO_4$), is 5.3%. This plating solution was also stable before and after the electroplating process, and no gold precipitates were observed after the electroplating process was completed.

Example 3

The gold electroplating solution (03) in Example 3 contained the composition of components A to F below, while pH=7.0.

| | |
|---|---|
| A: sodium gold (I) sulfite (as gold element) | 15 g/L, |
| B: sodium sulfite | 10 g/L, |
| C: sdium sulfate | 90 g/L, |
| D: thallium malonate (as thallium element) | 6 mg/L, |
| E: ammonium bismuth citrate (as element bismuth) | 140 mg/L, |
| F: sodium chloride | 0.5 g/L |

Here, the weight ratio of both catalysts (the sum of D:thallium malonate and E:ammonium bismuth citrate) to the barrier agent (B:sodium sulfite), or both catalysts (Bi+Tl)/barrier agent ($Na_2SO_3$) was $146\times10^{-4}$. The weight ratio of thallium catalyst to bismuth catalyst, or (Bi)/(Tl), was 23.3. The plating solution was also stable before and after the electroplating process, and no gold precipitates were observed after the electroplating process was completed.

The gold electroplating solution (04) in Example 4 contained the composition of components A-F below, while pH=10.0.

| | |
|---|---|
| A: sodium gold (I) sulfite (as gold element) | 15 g/L, |
| B: sodium sulfite | 180 g/L, |
| C: sodium sulfate | 20 g/L, |
| D: thallium nitrate (as thallium element) | 45 mg/L, |
| E: bismuth sulfamate (as element bismuth) | 35 mg/L, |
| F: ammonium hydroxide 15% (pH adjuster) | 10 mL |

Here, the weight ratio of both catalysts (D: thallium nitrate and E: bismuth sulfamate combined) to the barrier agent (B: sodium sulfite), i.e., both catalysts (Bi+Tl)/barrier agent ($Na_2SO_3$) was $4.4\times10^{-4}$. The weight ratio of thallium catalyst to bismuth catalyst, or (Bi)/(Tl), was 0.8. The plating solution was also stable before and after the electroplating process, and no gold precipitates were observed after the electroplating process was completed.

Example 5

The gold electroplating solution (05) in Example 5 contained the composition of components A to F below, while pH=8.0.

| | |
|---|---|
| A: sodium gold (I) sulfite (as gold element) | 15 g/L, |
| B: sodium sulfite | 65 g/L, |
| C: sodium sulfate | 30 g/L, |
| D: thallium nitrate (as thallium element) | 5 mg/L, |
| E: bismuth sulfamate (as element bismuth) | 30 mg/L |

Here, the weight ratio of both catalysts (D: thallium nitrate and E: bismuth sulfamate combined) to the barrier agent (B: sodium sulfite), i.e., both catalysts (Bi+Tl)/barrier agent ($Na_2SO_3$) was $5.4\times10^{-4}$. The weight ratio of thallium catalyst to bismuth catalyst, or (Bi)/(Tl), was 6.0. The plating solution was also stable before and after the electroplating process, and no gold precipitates were observed after the electroplating process was completed.

Example 6

The gold electroplating solution (06) in Example 6 contained the composition of components A to F below, while pH=8.0.

| | |
|---|---|
| A: sodium gold (I) sulfite (as gold element) | 15 g/L, |
| B: sodium sulfite | 65 g/L, |
| C: sodium sulfate | 30 g/L, |
| D: thallium nitrate (as thallium element) | 50 mg/L, |
| E: bismuth sulfamate (as element bismuth) | 150 mg/L |

Here, the weight ratio of both catalysts (D: thallium nitrate and E: bismuth sulfamate combined) to the barrier agent (B: sodium sulfite), i.e., both catalysts (Bi+Tl)/barrier agent ($Na_2SO_3$) was $30.8\times10^{-4}$. The weight ratio of thallium catalyst to bismuth catalyst, or (Bi)/(Tl), was 3.0. The plating solution was also stable before and after the electroplating process, and no gold precipitates were observed after the electroplating process was completed.

Example 7

The gold electroplating solution (07) of Example 7 contained the composition of components A to F below, while pH=8.0.

| | |
|---|---|
| A: sodium gold (I) sulfite (as gold element) | 5 g/L, |
| B: sodium sulfite | 65 g/L, |
| C: sodium sulfate | 30 g/L, |
| D: thallium nitrate (as thallium element) | 10 mg/L, |
| E: bismuth nitrate (as element bismuth) | 50 mg/L, |

and

Here, the weight ratio of both catalysts (the sum of D: thallium nitrate and E: bismuth nitrate) to the barrier agent (B: sodium sulfite), i.e., both catalysts (Bi+Tl)/barrier agent ($Na_2SO_3$) was $9.2\times10^{-4}$. The weight ratio of thallium catalyst to bismuth catalyst, or (Bi)/(Tl), was 5.0. The plating solution was also stable before and after the electroplating process, and no gold precipitates were observed after the electroplating process was completed.

Example 8

The gold electroplating solution (08) of Example 1 contained the composition of components A to F below, while pH=8.0.

| | |
|---|---|
| A: sodium gold (I) sulfite (as gold element) | 25 g/L, |
| B: sodium sulfite | 65 g/L, |
| C: sodium sulfate | 30 g/L, |
| D: thallium formate (as thallium element) | 10 mg/L, |
| E: bismuth nitrate (as elemental bismuth) | 50 mg/L, |

and

Here, the weight ratio of both catalysts (D: thallium formate and E: bismuth nitrate combined) to the barrier agent (B: sodium sulfite), i.e., both catalysts (Bi+Tl)/barrier agent ($Na_2SO_3$), was $9.2\times10^{-4}$. The weight ratio of thallium catalyst to bismuth catalyst, or (Bi)/(Tl), was 5.0. The plating solution was also stable before and after the electroplating process, and no gold precipitates were observed after the electroplating process was completed.

The component compositions and weight percentages, etc. of each component for the gold electroplating solutions (01) to (08) in Examples 1 to 8 above are listed in a simplified form in Table 1.

TABLE 1

| | Composition of Au-electroplating solution | Content units | Examples 1 | 2 | 3 | 4 | 5 | 6 | 7 | 8 |
|---|---|---|---|---|---|---|---|---|---|---|
| (a) | gold (I) sulfite complex | g/L | 15 | 15 | 15 | 15 | 15 | 15 | 5 | 25 |
| (b) | sulfurous acid or sulfites | g/L | 50 | 65 | 10 | 180 | 65 | 65 | 65 | 65 |
| (c) | sulfates | g/L | 15 | 30 | 90 | 20 | 30 | 30 | 30 | 30 |
| (d) | thallium catalysts | mg/L | 10 | 20 | 6 | 45 | 5 | 50 | 10 | 10 |
| (e) | bismuth catalysts | mg/L | 50 | 70 | 140 | 35 | 30 | 150 | 50 | 50 |
| (a)-(i) | Bi to Ti weight ratio | — | 5 | 4 | 23 | 0.8 | 6 | 3 | 5 | 5 |
| (j) | Weight ratio of Bi•Tl to sulfurous acid (salts) (e + d)/b | $\times10^{-4}$ | 12 | 14 | 146 | 4 | 5 | 31 | 9 | 9 |
| | pH | — | 8 | 12 | 7 | 10 | 8 | 8 | 8 | 8 |

Preparation of Test Substrate 1

A conductor circuit pattern was fabricated on the entire surface of a 3.0 mm thick silicon wafer substrate (200 mm diameter). Next, the following (Va)-(Vc) perforation holes (aspect ratio:Va-Vc) were drilled in this substrate, and then a 0.3 μm titanium-tungsten alloy intermediate film was vacuum deposited on this substrate, followed by a 0.1 μm gold base film. This was used as test substrate 1. A base gold film was also formed inside the drilled holes of test substrate 1.

(Va):
Aspect ratio: Va (diameter: 10 μm; depth: 10 μm; pitch: 50 μm) 10 pcs.
(Vb):
Aspect ratio: Vb (diameter: 5 μm, depth: 10 μm, pitch: 70 μm) 10 pcs.
(Vc):
Aspect ratio: Vc (diameter: 3 μm, depth: 9 μm, pitch: 100 μm) 10 pcs.

Preparation of Test Substrate 2

Test substrate 2 was prepared in the same way as test substrate 1, except that instead of 0.1 μm vacuum-deposited gold, 0.1 μm vacuum-deposited palladium was used. The inside of the drilled holes (aspect ratio: Va-Vc) in the test substrate 2 was also covered with the underlying palladium film.

Preparation of Test Substrate 3

A gold conductor circuit pattern was fabricated on the entire surface of a 3.0 mm thick silicon wafer substrate (200 mm diameter). First, 80 perforation holes of the following (Vc) were drilled in this substrate, and then a 0.3 μm titanium-tungsten alloy intermediate film was vacuum deposited, followed by a 0.1 μm gold coating film on top of them. This was used as test substrate 3. The inside of the drilled holes in test substrate 3 is also covered with the underlying gold vapor deposition film.

(Vc)
Aspect ratio: Vc (diameter: 3 μm, depth: 6 μm, pitch: 100 μm)

Production of Test Substrate 4

Palladium conductor circuit patterns were fabricated on the entire surface of a 3.0 mm thick silicon wafer substrate (200 mm diameter). Then, 80 drilled holes of the following (Vc) were drilled in this substrate, followed by a vacuum evaporation deposition of a 0.3 μm thick titanium-tungsten alloy intermediate film and a vacuum evaporation deposition of a 0.1 μm thick palladium coating film. This was used as test substrate 4.

(Vc)
Aspect ratio: Vc (diameter: 3 μm; depth: 6 μm; pitch: 100 μm)

Next, using the above gold electroplating solutions (01) through (08) and test substrates 1 through 4, various characteristics were evaluated by the following examples. The results of these evaluations are described below.

Measurement of Cathodic Polarization Curve

Example 9

The cathodic polarization curves of potential (vs. standard potential (Ag/AgCl)) and current in the gold electroplating solution (01) of Example 1 were measured using an Electro Chemical Measurement System (model: HZ-7000) manufactured by HOKUTO DENKO. This is Example 9. The cathodic polarization curve of Example 9 is shown by the solid line in FIG. 5. The potential and current at the inflection point of the cathodic polarization curve were −0.54 V and −1.28 mA, respectively.

Cross-Sectional Photograph of the Filling Inside the Drilled Hole

Example 10

Using gold electroplating solution (01) at a solution temperature of 55° C., a DC current was applied to test substrate 1 to thereby effect gold electroplating. The electroplating operation was performed for 4 minutes. Test substrate 1 was then rinsed and dried. This was Example 10. Cross-sectional photographs of the interior of the drilled holes of Example 10 are shown in FIG. 6. Va in FIG. 6 shows a drilled hole with diameter of 10 μm and depth of 10 μm, Vb shows a drilled hole with diameter of 5 μm and depth of 10 μm, and Vc shows a drilled hole with diameter of 3 μm and depth of 9 μm. The cross-sectional microstructure of the gold-plated film in each drilled hole was observed, respectively.

The cross section of the Via-filling filled with gold deposit inside the drilled hole (diameter: 10 μm, depth: 10 μm) of Va in FIG. 6 had a U-shaped structure. The corners of the drilled holes are where gold deposits grew during the catalytic inhibition reaction. The thickness of the gold plating film is largest at the corners, indicating that the catalyst inhibition reaction was most active there.

It can also be seen that the crystal grains of the gold plating film at the periphery and inside of the drilled hole are different. Comparing the black grains, those at both ends (periphery) of Va of FIG. 6 are fine, those in the center (bottom) are acorn-shaped, and those on both side walls extend in a tubular shape. In other words, the cross-sectional photograph of the gold-plated film in Va of FIG. 6 shows that the existing electrodeposition reaction occurred at the periphery of the grilled hole and the catalytic inhibition reaction of the present invention occurred at both side walls of the perforation hole, respectively. As a result of the autonomous occurrence of catalyst inhibition reaction and electrodeposition reaction in the gold electroplating solution (01) of Example 1, the thickness of the gold deposit with a Via-filled U-shaped cross-sectional structure is almost uniform even inside the drilled hole in Va of FIG. 6 of Example 10.

The gold deposit inside the drilled hole (diameter: 5 μm, depth: 10 μm) in Vb of FIG. 6 was formed by Via-filling deposition, and the cross section of the gold plating film has a U-shaped structure. The corners of the drilled holes are where gold deposits were deposited by the catalytic inhibition reaction. The thickness of the gold plating film is thickest at the corners, indicating that the catalyst inhibition reaction was most active there. Observation of the thickness of the gold-plated film in Vb of FIG. 6 reveals that the thickness of the film is almost uniform inside and around the grilled hole as a result of autonomous catalyst inhibition and electrolytic deposition reactions during the electroplating process of gold electroplating solution (01).

The gold deposit inside the drilled hole (diameter: 3 μm; depth: 9 μm) in Vc of FIG. 6 is compact-packed Via-filled with a U-shaped structure in cross section. Observing the thickness of the gold plating film in Vc of FIG. 6, it is found that the thickness at both sidewalls and that at the periphery of the drilled hole are almost uniform but that in the bottom thicker. The thickened area in Vc of FIG. 6 can be said to be the gold deposit due to the catalytic inhibition reaction of the present invention. Observing the crystal grains of the gold-plated film in Vc of FIG. 6, an inverse V-shaped crystal grain in cross section is observed at the bottom of the drilled hole, which is connected to coarse crystal grains on both sides, and these coarse crystal grains are connected to fine crystal grains on the periphery.

Comparing Va and Vb in FIG. 6, we can see that even though the diameter of the perforation hole in Vb of FIG. 6 (5 μm) is narrower than in Va of FIG. 6 (10 μm), the thickness of the gold plating film in Vb of FIG. 6 is almost as uniform as that in Va of FIG. 6. The gold deposits inside the drilled holes are all densely filled with Via-filling in a U-shaped cross-sectional structure. This indicates that in gold electroplating solution (01), the catalyst inhibition reaction inside the drilled hole and the electrolytic deposition reaction at the periphery work autonomously to make the thickness of the gold-plated film uniform.

The aspect ratio in Vc of FIG. 6 (diameter: 3 μm, depth: 9 μm) is higher than that in Va of FIG. 6 (diameter: 10 μm, depth: 9 μm), so the current density distribution inside the drilled hole in Vc of FIG. 6 is more sparse than in Va of FIG. 6. As shown in the schematic in FIG. 2, both catalysts are more active when the current density distribution is sparse. The thickness inside the drilled hole in Vc of FIG. 6 is greater than that in Va of FIG. 6 because the catalytic inhibition reaction by the bismuth catalyst in Vc of FIG. 6 is faster than in Va of FIG. 6. On the other hand, the thickness of the perimeter of the drilled hole in Vc of FIG. 6 is the same as the thickness in Va of FIG. 6, and no difference in the existing electrodeposition reaction is seen.

Example 11

Test substrate 1 was gold electroplated for 8 minutes using gold electroplating solution (01) in the same manner as in Example 10. This is Example 11 and a photograph of the cross section after the 8 minutes is shown in FIG. 7. The cross-sectional photographs in FIG. 7 are scanning ion microscope images (SIM images) taken from obliquely above the drilled holes (Va, Vb, and Vc), which were all split in half by a focused ion beam system (MI4050, Hitachi High-Tech Corporation), as in Example 10. Similarly as in the case of FIG. 6, the gold plating films of Va in FIG. 7 (diameter: 10 μm, depth: 10 μm), Vb in the same (diameter: 5 μm, depth: 10 μm) and Vc in the same (diameter: 3 μm, depth: 9 μm) were observed, respectively.

The gold deposit cross sections inside the drilled holes in the gold plating films of Va, Vb, and Vc in FIG. 7 are all densely packed with Via-filling and have a U-shaped cross-sectional structure. FIG. 7's Va, Vb, and Vc all show no cavities or voids on the centerline of the drilled hole, which are seen at (a) of FIG. 1. A gentle depression is seen on the conductor circuit pattern in Vc of FIG. 7.

Next, FIG. 7's Va, Vb, and Vc of Example 11 are compared with FIG. 6's Va, Vb, and Vc of Example 10. In FIG. 7's Va, Vb, and Vc of Example 11, a tendency of rapid increase in the thickness of the gold deposit with the aspect ratio increase is observed. This tendency is similar to that shown in FIG. 6's Va, Vb, and Vc in Example 10. Comparing the compactly-packed gold deposit of Va (diameter: 10 μm, depth: 10 μm) in FIG. 6 with the gold deposit of Va (diameter: 10 μm, depth: 10 μm) in FIG. 7, it can be observed that the influence of the depth of the U-shaped groove is greater in Va in FIG. 6 than in FIG. 7. This indicates that as the diameter of the drilled hole increases, the electrodeposition reaction is more readily to occur than the catalyst inhibition reaction, and the deposition of gold deposits by the catalyst inhibition reaction is less likely to occur.

Example 12

Test substrate 3 was plated in gold electroplating solution (01) with cathodic current densities of 0.2 A/dm$^2$ and 0.4 A/dm$^2$ to thereby obtain Via-filling deposition inside the drilled holes. The gold electroplating solution (01) contained 10 mg/L of thallium formate (as thallium element) and 50 mg/L of bismuth nitrate (as bismuth element). Subsequently, a glow discharge mass spectrometer (model: Astrum) manufactured by AMETEK was used to analyze trace amounts of bismuth and thallium elements in the Via-filled gold deposits.

The bismuth element in the deposits obtained by the gold electroplating process measured 1.24 ppm and 1.78 ppm at cathode current densities of 0.2 A/dm$^2$ and 0.4 A/dm$^2$, respectively. On the other hand, the thallium element failed to be detected when measured by an analyzer capable of detecting thallium at an order of 0.01 ppm (manufactured by). When the similar Au-electroplating was performed with a 5° C. lower solution temperature, the bismuth element content increased, but none of the thallium elements were detected.

The analysis results in Example 12 show that, in the case of gold electroplating solution of the present invention, the bismuth element in the gold deposit increases with increasing cathode current density. On the other hand, the thallium element is not included in the gold deposit. The fact that the content of the bismuth element is also affected by the current density and liquid temperature indicates that if plating conditions suitable for the aspect ratio of the drilled holes are selected, it is possible to minimize the entrainment of the bismuth element in the gold deposit.

Examples 13-40

Next, test substrate 1 and test substrate 2 were gold electroplated for 4 and 8 minutes using gold electroplating solutions (02) through (08). The cross sections inside the drilled holes of test substrate 1 and test substrate 2 after 4 and 8 minutes were observed for each gold electroplating solution (02) to (08), respectively. These cross-sectional photographs (not shown) were similar to the cross-sectional photographs of the drilled holes (Va, Vb and Vc) in FIGS. 6 and 7. The example pertaining to gold electroplating solution (02) after 4 minutes for test substrate 1 is designated as Example 13, and that pertaining to gold electroplating solution (08) is designated as Example 19. Similarly, the example pertaining to gold electroplating solution (02) after 8 minutes is designated as Example 20, and that pertaining to gold electroplating solution (08) is designated as Example 26. The example pertaining to gold electroplating solution (02) after 4 minutes for test substrate 2 is designated as Example 27, and that pertaining to gold electroplating solution (08) is designated as Example 33. Similarly, the example pertaining to gold electroplating solution (02) after 8 minutes is designated as Example 34, and that pertaining to gold electroplating solution (08) is designated as Example 40.

Thickness and Deviation of Gold Plating Coating

Examples 41-46

Next, a conductive circuit pattern with a gold film was fabricated on the entire surface of a 3.0 mm thick silicon wafer substrate (200 mm diameter) to make Test Substrate 3 in the examples. The test substrate 3 was electroplated by applying DC current to the gold electroplating solutions (01) to (06) of the examples, and electroplating operation was performed at a liquid temperature of 55° C. for 8 minutes. That is, the plating film in Example 41 was obtained by gold electroplating solution (01), Example 42 was from gold electroplating solution (02), Example 43 was from gold electroplating solution (03), Example 44 was from gold electroplating solution (04), Example 45 was from gold electroplating solution (05), and Example 46 was from gold electroplating solution (06).

The thickness of the gold plating film on test substrate 3 was sectioned by focused ion beam (FIB). Five cross sections were measured with a SIM device (Hitachi High-Technologies, MI4050), and the mean and standard deviation of the five cross sections were determined. The results of the film thickness of the six gold-plated films in Examples 41-46 are shown in Table 2.

TABLE 2

| | Test substrate 3 | |
|---|---|---|
| | average value (μm) | standard deviation |
| Example 41 | 2.18 | 0.15 |
| Example 42 | 2.11 | 0.12 |
| Example 43 | 2.13 | 0.12 |
| Example 44 | 2.13 | 0.14 |
| Example 45 | 2.12 | 0.13 |
| Example 46 | 2.13 | 0.12 |

As shown in Table 2, there was little difference in the average thickness and its deviation of the gold-plated film thickness for test substrates 3 in Examples 41-46. In other words, the average film thicknesses of the gold electroplating solutions (01) to (06) in Examples 41 to 46 ranged narrowly from 2.11 to 2.18 μm, and the standard deviation (3σ) ranged no more than from 0.12 to 0.15.

Examples 47-52

Next, a palladium film conductor circuit pattern was fabricated on the entire surface of a 3.0 mm thick silicon wafer substrate (200 mm diameter) to make test substrate 4 in the examples. The test substrate 4 was subjected to the same electroplating operation as test substrate 3, applying DC current to the gold electroplating solutions (01) through (06) in the examples and electroplating at a liquid temperature of 55° C. for 8 minutes, and the average values and standard deviations for the five locations were determined. The results of the film thickness of the six gold-plated films in Examples 47-52 are shown in Table 3.

TABLE 3

| | Test substrate 4 | |
|---|---|---|
| | average value (μm) | standard deviation |
| Example 47 | 2.25 | 0.13 |
| Example 48 | 2.14 | 0.11 |

TABLE 3-continued

| | Test substrate 4 | |
|---|---|---|
| | average value (μm) | standard deviation |
| Example 49 | 2.14 | 0.12 |
| Example 50 | 2.13 | 0.12 |
| Example 51 | 2.13 | 0.14 |
| Example 52 | 2.14 | 0.13 |

As Table 3 shows, there were only slight differences in the average thickness and its deviation of the palladium plating film thickness for Test Substrates 4 in Examples 47-52. In other words, the average film thicknesses of the gold electroplating solutions (01) to (06) in Examples 47 to 52 ranged only from 2.13 to 2.25 μm, and the standard deviation (3σ) ranged scarcely from 0.11 to 0.14.

Next, comparative examples are described and specifically compared to the examples of the present invention. Gold electroplating solutions (09) to (18) with the following compositions were prepared as comparative examples. These gold electroplating solutions were designated as Comparative Examples 1 to 10.

Stability of Gold Electroplating Solutions

Comparative Example 1

Gold electroplating solution (09) contained the following composition of components A to F, while pH=8.0.

| | |
|---|---|
| A: sodium gold (I) sulfite (as gold element) | 15 g/L |
| B: sodium sulfite | 50 g/L |
| C: sodium sulfate | 15 g/L |
| D: thallium formate (as thallium element) | 0 mg/L |
| E: bismuth nitrate (as bismuth element) | 50 mg/L |
| F: sodium phosphate | 1 g/L |

Gold electroplating solution (09) is the same as gold electroplating solution (01) except that thallium formate was excluded (specified as "0 mg/L"). Here, the weight ratio of both metal salts (D: thallium formate and E: bismuth nitrate combined) to the barrier agent (B: sodium sulfite), i.e., sum of metal salts (Bi+Tl) divided by barrier agent ($Na_2SO_3$) was $10\times10^{-4}$. The plating solution was stable before and after the electroplating process, and no gold precipitates were observed after the electroplating process had been completed.

Comparative Example 2

Gold electroplating solution (10) contained the following composition of components A to F, while pH=8.0.

| | |
|---|---|
| A: sodium gold (I) sulfite (as gold element) | 15 g/L |
| B: sodium sulfite | 50 g/L |
| C: sodium sulfate | 15 g/L |
| D: thallium formate (as thallium element) | 10 mg/L |
| E: bismuth nitrate (as bismuth element) | 0 mg/L |
| F: sodium phosphate | 1 g/L |

Gold electroplating solution (10) was the same as gold electroplating solution (01) except that bismuth nitrate was excluded (specified as "0 mg/L"). Here, the weight ratio of both metal salts (D: thallium formate plus E: bismuth nitrate combined) to the barrier agent (B: sodium sulfite), i.e., sum of metal salts (Bi+Tl) divided by barrier agent ($Na_2SO_3$) was $2.0\times10^{-4}$. The weight ratio of thallium catalyst to bismuth catalyst, i.e., (Bi)/(Tl), was 0. This plating solution was also stable before and after the electroplating process, and no gold precipitates were observed after the electroplating process had been completed.

Comparative Example 3

Gold electroplating solution (11) contained the following composition of components A to F, while pH=6.0.

| | |
|---|---|
| A: sodium gold (I) sulfite (as gold element) | 15 g/L |
| B: sodium sulfite | 50 g/L |
| C: sodium sulfate | 15 g/L |
| D: thallium formate (as thallium element) | 60 mg/L |
| E: bismuth nitrate (as bismuth element) | 180 mg/L |
| F: ammonium phosphate | 6 g/L |

Gold electroplating solution (11) in Comparative Example 3 was same as gold electroplating solution (01) except that D: thallium formate was 60 mg/L, E: bismuth nitrate was 180 mg/L, F: ammonium phosphate was 6 g/L and pH=6.0. Here, the weight ratio of both metal salts (D: thallium formate and E: bismuth nitrate combined) to the barrier agent (B: sodium sulfite), i.e., metal salts combined (Bi+Tl)/barrier agent ($Na_2SO_3$) was $48\times10^{-4}$. The weight ratio of thallium salt to bismuth salt, or (Bi)/(Tl), was 3.0. This plating solution was also stable before and after the electroplating process, and no gold precipitates were observed after the electroplating process had been completed.

Comparative Example 4

Gold electroplating solution (12) contained the following composition of components A to F, while pH=8.0.

| | |
|---|---|
| A: sodium gold (I) sulfite (as gold element) | 15 g/L, |
| B: sodium sulfite | 50 g/L, |
| C: sodium sulfate | 15 g/L, |
| D: thallium formate (as thallium element) | 30 mg/L, |
| E: bismuth nitrate (as elemental bismuth) | 10 mg/L, |
| F: sodium phosphate | 1 g/L |

The gold electroplating solution (12) of Comparative Example 4 is the same as the gold electroplating solution (01) except that D: thallium formate was 30 mg/L and E: bismuth nitrate was 10 mg/L. Here, the weight ratio of both metal salts (the sum of D: thallium formate and E: bismuth nitrate) to the barrier agent (B: sodium sulfite), i.e., both metal salts (Bi+Tl)/barrier agent ($Na_2SO_3$) was $8\times10^{-4}$. The weight ratio of thallium salt to bismuth salt, i.e., (Bi)/(Tl) was 3.0. The plating solution was also stable before and after the electroplating process, and no gold precipitates were observed after the electroplating process had been completed.

Comparative Example 5

The gold electroplating solution (13) contained the following composition of ingredients A to F, while pH=8.0.

| | |
|---|---|
| A: sodium gold (I) sulfite (as gold element) | 15 g/L, |
| B: sodium sulfite | 65 g/L, |
| C: sodium sulfate | 30 g/L, |

-continued

| | |
|---|---|
| D: thallium formate (as thallium element) | 3 mg/L, |
| E: bismuth nitrate (as element bismuth) | 70 mg/L, |
| F: sodium chloride | 0.5 g/L |

Gold electroplating solution (13) is the same as gold electroplating solution (05) except that D: thallium formate was 3 mg/L and E: bismuth nitrate was 70 mg/L. Here, the weight ratio of both metal salts (the sum of D: thallium formate and E: bismuth nitrate) to the barrier agent (B: sodium sulfite), that is, both metal salts (Bi+Tl)/barrier agent ($Na_2SO_3$) was $11.2\times10^{-4}$. The weight ratio of thallium salt to bismuth salt, i.e., (Bi)/(Tl) was 3.0. The plating solution was also stable before and after the electroplating process, and no gold precipitates were observed after the electroplating process had been completed.

Comparative Example 6

Gold electroplating solution (14) contained the following composition of components A to F, while pH=8.0.

| | |
|---|---|
| A: sodium gold (I) sulfite (as gold element) | 15 g/L, |
| B: sodium sulfite | 65 g/L, |
| C: sodium sulfate | 30 g/L, |
| D: thallium formate (as thallium element) | 60 mg/L, |
| E: bismuth nitrate (as element bismuth) | 70 mg/L, and |
| F: sodium chloride | 0.5 g/L |

Gold electroplating solution (14) is the same as gold electroplating solution (05) except that D: thallium formate was 60 mg/L and E: bismuth nitrate was 70 mg/L. Here, the weight ratio of both metal salts (the sum of D: thallium formate and E: bismuth nitrate) to the barrier agent (B: sodium sulfite), i.e., both metal salts (Bi+Tl)/barrier agent ($Na_2SO_3$) was $20\times10^{-4}$. The weight ratio of thallium salt to bismuth salt, i.e., (Bi)/(Tl) was 1.2. The plating solution was also stable before and after the electroplating process, and no gold precipitates were observed after the electroplating process had been completed.

Comparative Example 7

Gold electroplating solution (15) contained the following composition of components A to F, while pH=8.0.

| | |
|---|---|
| A: sodium gold (I) sulfite (as gold element) | 15 g/L, |
| B: sodium sulfite | 65 g/L, |
| C: sodium sulfate | 30 g/L, |
| D: thallium formate (as thallium element) | 20 mg/L, |
| E: bismuth nitrate (as element bismuth) | 20 mg/L, |
| F: sodium chloride | 0.5 g/L |

Gold electroplating solution (15) is the same as gold electroplating solution (05) except that D: thallium formate was 20 mg/L and E: bismuth nitrate was 20 mg/L. Here, the weight ratio of both metal salts (the sum of D: thallium formate and E: bismuth nitrate) to the barrier agent (B: sodium sulfite), that is, both metal salts (Bi+Tl)/barrier agent ($Na_2SO_3$) was $6.2\times10^{-4}$. The weight ratio of thallium salt to bismuth salt, i.e., (Bi)/(Tl) was 1. The plating solution was also stable before and after the electroplating process, and no gold precipitates were observed after the electroplating process had been completed.

Comparative Example 8

Gold electroplating solution (16) contained the following composition of components A to F, while pH=8.0.

| | |
|---|---|
| A: sodium gold (I) sulfite (as gold element) | 15 g/L, |
| B: sodium sulfite | 65 g/L, |
| C: sodium sulfate | 30 g/L, |
| D: thallium formate (as thallium element) | 20 mg/L, |
| E: bismuth nitrate (as element bismuth) | 180 mg/L, |
| F: sodium chloride | 0.5 g/L. |

Gold electroplating solution (16) is the same as gold electroplating solution (05) except that D: thallium formate was 20 mg/L and E: bismuth nitrate was 180 mg/L. Here, the weight ratio of both metal salts (the sum of D: thallium formate and E: bismuth nitrate) to the barrier agent (B: sodium sulfite), that is, both metal salts (Bi+Tl)/barrier agent ($Na_2SO_3$) was $6.2\times10^{-4}$. The weight ratio of thallium salt to bismuth salt, i.e., (Bi)/(Tl) was 9. The plating solution was also stable before and after the electroplating process, and no gold precipitates were observed after the electroplating process had been completed.

Comparative Example 9

Gold electroplating solution (17) contained the following composition of components A to F, while pH=8.0.

| | |
|---|---|
| A: sodium gold (I) sulfite (as gold element) | 5 g/L, |
| B: sodium sulfite | 65 g/L, |
| C: sodium sulfate | 30 g/L. |
| D: thallium nitrate (as thallium element) | 30 mg/L, |
| E: bismuth nitrate (as bismuth element) | 10 mg/L |

Gold electroplating solution (17) is the same as gold electroplating solution (07) except that D: thallium nitrate was 30 mg/L and E: bismuth nitrate was 10 mg/L. Here, the weight ratio of both metal salts (the sum of D: thallium formate and E: bismuth nitrate) to the barrier agent (B: sodium sulfite), i.e., both metal salts (Bi+Tl)/barrier agent ($Na_2SO_3$) was $6.2\times10^{-4}$. The weight ratio of thallium salt to bismuth salt, or (Bi)/(Tl), was 0.3. The plating solution was also stable before and after the electroplating process, and no gold precipitates were observed after the electroplating process had been completed.

Comparative Example 10

Gold electroplating solution (18) contained the following composition of components A to F, while pH=8.0.

| | |
|---|---|
| A: Sodium gold (I) sulfite (as gold element) | 25 g/L, |
| B: Sodium sulfite | 65 g/L, |
| C: sodium sulfate | 30 g/L, |
| D: Thallium formate (as thallium element) | 30 mg/L |
| E: Bismuth nitrate (as bismuth element) | 10 mg/L. |

Gold electroplating solution (18) is the same as gold electroplating solution (08) except that D: thallium formate was 30 mg/L and E: bismuth nitrate was 10 mg/L. Here, the weight ratio of both metal salts (the sum of D: thallium formate and E: bismuth nitrate) to the barrier agent (B: sodium sulfite), i.e., both metal salts (Bi+Tl)/barrier agent ($Na_2SO_3$) was $6.2\times10^{-4}$. The weight ratio of thallium salt to bismuth salt, i.e., (Bi)/(Tl) was 0.3. The plating solution was also stable before and after the electroplating process, and no gold precipitates were observed after the electroplating process had been completed.

The component compositions and weight percentages, etc. of each component of the gold electroplating solutions (09) to (18) in Comparative Examples 1 to 10 are listed in Table 4.

TABLE 4

| | Composition of gold electroplating solution | Unit of contents | Comparative Examples 1 | 2 | 3 | 4 | 5 | 6 | 7 | 8 | 9 | 10 |
|---|---|---|---|---|---|---|---|---|---|---|---|---|
| (a) | gold(I) sulfite complex | g/L | 15 | 15 | 15 | 15 | 15 | 15 | 15 | 15 | 5 | 25 |
| (b) | sulfurous acid or sulfite | g/L | 50 | 50 | 50 | 50 | 65 | 65 | 65 | 65 | 65 | 65 |
| (c) | sulfate | g/L | 15 | 15 | 15 | 15 | 30 | 30 | 30 | 30 | 30 | 30 |
| (d) | thallium catalyst | mg/L | 0 | 10 | 60 | 30 | 3 | 60 | 20 | 20 | 30 | 30 |
| (e) | bismuth catalyst | mg/L | 50 | 0 | 180 | 10 | 70 | 70 | 20 | 180 | 10 | 10 |
| (g)-(i) | weight ratio of Tl to Bi ((e)/(d)) | — | — | 0 | 3.0 | 0.3 | 23 | 1.2 | 1.0 | 9.0 | 0.3 | 0.3 |
| (j) | Weight ratio of Bi plus Tl to sulfurous acid (salt) (e + d)/b | $\times10^4$ | 10 | 2 | 48 | 8 | 11 | 20 | 6 | 31 | 6 | 6 |
| | pH | — | 8 | 8 | 6 | 8 | 8 | 8 | 8 | 8 | 8 | 8 |

Measurement of Cathodic Polarization Curve

Comparison Example 11

Next, the potential (pairwise standard potential (Ag/AgCl)) and the cathodic polarization curve of the current in the gold electroplating solution (12) of Comparative Example 4 were measured in the same way as in the gold electroplating solution (01) of Example 1 described above. These are Example 9 and Comparative Example 11, and are shown as dashed lines in FIG. 5. The potential and current at the inflection point of Comparative Example 11 were −0.52 V and −1.18 mA, respectively.

Deposits in Gold Electroplating Solution

Comparison Example 12

Next, test substrate 3 was immersed in gold electroplating solution (12) and Via-filling plating was performed at cathode current densities of 0.2 A/dm$^2$ and 0.4 A/dm$^2$. This gold electroplating solution (12) contained 30 mg/L of thallium formate (as thallium element) and 10 mg/L of bismuth nitrate (as bismuth element), even though the liquid composition deviated from that of the gold electroplating solution of the present invention. Subsequently, a glow discharge mass spectrometer (model: Astrum; manufactured by AMETEK) was used to analyze trace amounts of bismuth and thallium elements in the Via-filled gold deposits.

The thallium element in the resulting deposit was 2.76 ppm at a cathode current density of 0.2 A/dm$^2$ and 4.61 ppm at a cathode current density of 0.4 A/dm$^2$. On the other hand, none of the bismuth elements were detected. The content of the bismuth element was not detected, which is to say the amount of bismuth element was beneath the detection limit of 0.01 ppm. When the same gold electroplating was performed with a 5° C. lower liquid temperature, the thallium element content increased, but none of the bismuth element was detected.

The results show that in the comparative gold electroplating solution (12), the thallium element in the gold deposit increases as the cathode current density increases. On the other hand, the bismuth element was not found in the gold electrodeposits. The content of thallium elements is also influenced by the current density and liquid temperature of the gold electroplating solution.

Filler Inside Drilled Hole

Comparative Example 13

Test substrate 1 was gold electroplated using gold electroplating solution (11). The gold electroplating solution (11) had 60 mg/L of thallium component, which is greater than the upper limit of 50 mg/L defined by the present invention, and also it (11) had 180 mg/L of bismuth component, which is also greater than the upper limit of 150 mg/L defined by the same. The electroplating operation was performed for 4 minutes. This is Comparative Example 13. In this, cross-sectional photographs of the inside of the drilled hole were taken at the end of the 4 minutes and are shown in FIG. 8. These cross-sectional photographs are compared with the cross-sectional photographs of the interior of the drilled hole in FIG. 6 of Example 10.

The gold-plated films of Va (diameter: 10 μm, depth: 10 μm), Vb (diameter: 5 μm, depth: 10 μm) and Vc (diameter: 3 μm, depth: 9 μm) in FIG. 8 were studied respectively. FIG. 8's Va, Vb, and Vc all show rectangular profiles, looking like the internal shape of the drilled hole. This indicates that even though thallium and bismuth ions coexisted in the gold electroplating solution (11) in Comparative Example 13, the catalytic inhibition reaction as shown in FIG. 3 did not occur.

The Au plating film in Vc of FIG. 8 is the same at the periphery and inside the drilled hole. This indicates that the sulfite ion group acted as a barrier agent against thallium and bismuth ions, and in particular weakened the deposition inhibiting effect of the bismuth catalyst on Au, as shown in FIG. 4. This is because when an object is electroplated in an existing gold electroplating solution, the current density distribution on the cathode surface becomes coarse and dense, resulting in thicker openings in the drilled holes, as shown at (a) of FIG. 1.

Comparative Example 14

Test substrate 1 was gold electroplated for 8 minutes using the same gold electroplating solution (11) as in Comparative Example 13. This is Comparative Example 14. A cross-sectional photograph of the interior of the drilled hole in Comparative Example 14 after 8 minutes is shown in FIG. 9. This cross-sectional photograph is compared with the cross-sectional photograph of the inside of the drilled hole in FIG. 7 of Example 11.

The gold plating films of Va, Vb and Vc of FIG. 9 were observed respectively. The plated films of Va, Vb and Vc of FIG. 9 are similar to those of FIG. 8. Even as the aspect ratio increases from Va to Vc in FIG. 9, the thickness of the gold-plated film on the centerline of the drilled hole remains constant. This is because thallium ions act preferentially as crystal regulators more than bismuth ions do, and the existing electrolytic deposition reaction caused the gold deposit as shown in FIG. 4. A seam-like void was observed in the gold-plated film in Vc of FIG. 9, which is also illustrated in (a) of FIG. 1. Such cavities may result in plating swelling on the wiring or poor contact with other electronic components.

Next, test substrate 1 and test substrate 2 were gold electroplated for 4 and 8 minutes using gold electroplating solutions (01), (02), and (04) through (16). The cross sections inside the drilled holes of test substrate 1 and test substrate 2 after 4 and 8 minutes were observed for each gold electroplating solution. These cross-sectional photographs (not shown) were similar to the cross-sectional photographs of the drilled holes (Va, Vb and Vc) in FIGS. 8 and 9. In other words, in both cases, like in the case of FIG. 9 Vc of gold electroplating solution (11), voids were found in the gold plating film on the centerline of the drilled hole which resemble the ones shown at (a) of FIG. 1.

Thickness and Deviation of Gold Plating Coating

Comparative Examples 15-21

Next, a gold film conductor circuit pattern was fabricated on the entire surface of a 3.0 mm thick silicon wafer substrate (200 mm diameter) to make Test Substrate 3 for comparative examples. The test substrate 3 was electroplated with seven different gold electroplating solutions (09) to (15) from Comparative Examples 15 to 21 by applying a DC current to the test substrate 3 for 8 minutes at a liquid temperature of 55° C. The thickness of the gold plating film on test substrate 3 was then measured in the same manner as in Examples, and the mean and standard deviation of the five locations were determined. The results of the average thickness and deviation of the seven gold-plated films of these Comparative Examples 15-21 are shown in Table 5.

TABLE 5

| | Test substrate 3 | |
|---|---|---|
| | Average thickness (μm) | Standard deviation |
| Comparative Example 15 | 2.15 | 0.12 |
| Comparative Example 16 | 2.14 | 0.15 |
| Comparative Example 17 | 2.18 | 0.11 |
| Comparative Example 18 | 2.15 | 0.12 |
| Comparative Example 19 | 2.16 | 0.13 |
| Comparative Example 20 | 2.13 | 0.12 |
| Comparative Example 21 | 2.14 | 0.14 |

As is seen from Table 5, there was only small difference in the average thickness and in its standard deviation in the case of the gold-plated film of test substrate 3. In particular, the average film thickness in the cases of the seven gold electroplating solutions (09) to (15) in Comparative Examples 15 to 21 ranged from 2.13 to 2.18 μm, with a standard deviation (3σ) ranging from 0.11 to 0.14.

Comparative Examples 22-28

Next, a palladium film conductor circuit pattern was fabricated on the entire surface of a 3.0 mm thick silicon wafer substrate (200 mm diameter) to make Test Substrate 4 for further comparative examples. The test substrate 4 was electroplated in the same manner as test substrate 3 for 8 minutes at a liquid temperature of 55° C. by applying DC current to seven different gold electroplating solutions (09) to (15) from Comparative Examples 22 to 28. The same was then measured as for the gold-plated film on test substrate 3, and the mean and standard deviation of the thickness of the palladium-plated film at the five locations were determined. These results are shown in Table 6.

TABLE 6

| | Test substrate 4 | |
|---|---|---|
| | Average thickness (μm) | Standard deviation |
| Comparative Example 22 | 2.13 | 0.10 |
| Comparative Example 23 | 2.16 | 0.11 |
| Comparative Example 24 | 2.17 | 0.10 |
| Comparative Example 25 | 2.16 | 0.10 |
| Comparative Example 26 | 2.17 | 0.11 |
| Comparative Example 27 | 2.17 | 0.12 |
| Comparative Example 28 | 2.15 | 0.11 |

As Table 6 shows, there was only small difference in the average thickness and in its standard deviation in the case of the gold-plated film of test substrate 4. In particular, the average film thickness in the cases of the seven gold electroplating solutions (09) to (15) in Comparative Examples 22 to 28 ranged from 2.13 to 2.17 μm, with a standard deviation (3σ) ranging from 0.10 to 0.12.

Comparison Among the Examples

Next, comparison and study with regard to each of the above-mentioned properties of the gold electroplating solution among the Examples and Comparative Examples will be made.

Solution Stability of Gold Electroplating Solution

It can be seen that the gold electroplating solutions (01) to (08) in Examples 1 to 8 and (09) to (18) in Comparative Examples 1 to 10 were all stable before and after the electroplating process, and no gold precipitates were observed after the electroplating process was completed. In short, there was scarce difference in the stability of the gold electroplating solution between Examples and Comparative Ones.

Measurement of Cathodic Polarization Curve

Now, comparison shall be made between the potential (−0.54 V) and current (−1.28 mA) at the inflection point of the solid line in FIG. 5 of Example 9 using gold electroplating solution (01) on one hand and the potential (−0.52 V) and current (−1.18 mA) at the inflection point of the broken line in FIG. 5 of Comparison Example 11 using gold electroplating solution (12) on the other. Focusing on the voltage values in both cases, it can be seen that the solid line in Example 9 has a higher voltage in the gold electroplating process than the dashed line in Comparative Example 11. In other words, the liquid resistance of gold electroplating solution (01) is larger than that of gold electroplating solution (12). This difference in liquid resistance suggests that the gold electroplating solution (01) of Example 9 is more prone to electrolytic inhibition reaction by bismuth catalyst, while the gold electroplating solution (12) of Comparative Example 11 is more prone to electrolytic deposition promotion reaction by thallium catalyst. Also, the presence of two inflection points implies that the presence of the two metal catalysts created as many rates of the reduction-precipitation reaction.

Deposits in Gold Eleectroplating Solution

Comparison between the analysis results of electrodeposits in gold electroplating solution (01) and those in the case of gold electroplating solution (12) would suggest the following. Even though the gold electroplating process in Comparative Example 12 is similar to that in Example 7, the deposit in the drilled holes becomes different if the composition ratio of gold electroplating solution (12) and that of gold electroplating solution (01) is different. The analysis results about the electrodeposits in gold electroplating solution (12) of Comparative Example 12 show that the bismuth-catalyzed electrodeposition reaction depicted in FIG. 4 did not occur.

Filler Inside Drilled Hole

Next, a comparison is made between the cross-sectional photographs of FIG. 6Va, Vb, and Vc caused by gold electroplating solution (01) in Example 10 on one hand and those of FIG. 8Va, Vb, and Vc caused by gold electroplating solution (11) in Comparative Example 13 on the other. The gold-plated film in Va of FIG. 6 (diameter: 10 μm; depth: 10 μm) is U-shaped in cross section, whereas the gold-plated film in FIG. 8Va is square in cross section. Focusing on the corners inside the drilled holes, it is seen that the thickness of the gold-plated film in Va of FIG. 6 in the Example is greater than that of the gold-plated film in FIG. 8Va in the Comparison Example. The difference in the shape of the gold-plated film in the corners inside the drilled holes is due to the presence or absence of the catalyst suppression reaction attributable to the present invention. The U-shaped gold plating film in cross section of Example 10 is brought about by the presence of prescribed amounts of sulfite ions, bismuth catalyst and thallium catalyst in the gold electroplating solution (01).

In all of the cross-sectional photos of Va through Vc of FIG. 6 of Example 10, the gold deposit is compactly packed from the bottom to the middle part inside all of the drilled holes; and in the cross-sectional photo as Vc of FIG. 6, the Via-filled gold deposit filling the inside of the drilled hole has a thickness greater than that of the gold deposit at the periphery. On the other hand, in the cross-sectional photographs of Va, Vb, and Vc in FIG. 8 of Comparative Example 13, gold-plated films seem deposited to have fairly uniform thicknesses. According to the cross-sectional Photograph Vc in FIG. 8, there seems scarce difference between the thickness of the Via-filled gold deposit inside the high-aspect-ratio drilled hole and the thickness of the gold deposit at the periphery.

Cross-sectional photographs of the interiors of the drilled holes in Va, Vb, and Vc in FIG. 9 of Comparative Example 14 are compared with those in FIG. 7's Va, Vb, and Vc of Example 11, respectively. The relationship between FIG. 9's Va, Vb, Vc and FIG. 7's Va, Vb, Vc is found to be the same as the relationship between FIG. 8's Va, Vb, Vc of Comparative Example 13 and FIG. 6's Va, Vb, Vc of Example 11.

Thickness and Deviation of Gold-Plated Films

In the case of test substrate 3, which has a gold film as the substrate surface, a comparison between Table 2 and Table 5 clearly shows that the mean values and standard deviations (3σ) of film thicknesses in the six gold electroplating solutions (01) to (06) of Examples 41 to 46 and those in the seven gold electroplating solutions (09) to (15) of Comparative Examples 15 to 21 are all within such narrow ranges that virtually no differences were observed between the Examples and Comparative Examples.

In the case of test substrate 4, which has a palladium plated film as the substrate surface, a comparison between Table 3 and Table 6 clearly shows that the mean values and standard deviations (3σ) of film thicknesses in the six gold electroplating solutions (01) to (06) of Examples 47 to 52 and those in the seven gold electroplating solutions (09) to (15) of Examples 22 to 28 are all within such narrow ranges that virtually no differences were observed between the Examples and Comparative Examples.

As shown above, the gold electroplating solutions (01) through (06) of the Examples have similar liquid stability as the gold electroplating solutions (09) to (15) of the Comparative Examples, and also the average and standard deviation of the gold plating film thickness of the Examples are good and acceptable. Moreover, the gold electroplating solution of the present invention has better Via-filling characteristics for gold deposition into the drilled hole than those of the comparative examples, indicating that it is preferable to preferentially involve the bismuth element in the gold deposit.

It has been confirmed that, in the gold electroplating solution of the present invention, the thallium catalyst and bismuth catalyst have deposition inhibiting and uniform deposition promoting effects, respectively, on the sulfite ion group present in an appropriate ratio, without the use of complex polymer compounds or surfactants, thereby inhibiting growth near the drilled hole opening and preferentially depositing on the interior, especially on the drilled hole's bottom. In other words, according to the present invention, the gold electroplating solution and the gold electroplating method are not affected by the current density distribution across the plated material, and hence a stable electroplating work is performed. Also, as shown at (b) of FIG. 1, it is also possible to form compactly packed Via-filling deposition with a stacked structure that consists of cross-sectionally U-shaped layers. Moreover, the deposits from the gold electroplating solution do not virtually involve harmful thallium elements.

INDUSTRIAL APPLICABILITY

According to the present invention, the gold electroplating solution and gold electroplating method can continuously pack gold deposits densely inside drilled holes by autonomous catalyst suppression reaction even if the current density distribution inside the perforation hole fluctuates irregularly during the electroplating operation. The presently invented gold electroplating solution and gold electroplating method are also widely applicable to various applications of existing Via-filling depositions.

Scope of what is claimed:

1. A cyanide-free gold electroplating solution for forming gold deposits containing bismuth preferentially over thallium and compact-packed via-filling deposit with a U-shaped stacked structure in cross section inside drilled holes, comprising the following basic elements and additional elements, said basic elements being:

(a) gold (I) sulfite complex (as gold element) 1-30 g/L (b) sulfurous acid or sulfites 5-200 g/L (c) sulfate 3-150 g/L and said additional elements being:

(d) bismuth catalyst (as bismuth element) 30-150 mg/L (e) thallium catalyst (as thallium element) 5-50 mg/L.

2. A cyanide-free gold electroplating solution according to claim 1, wherein a ratio of a weight of said bismuth element (d) to that of said thallium element (e), is 0.6 to 30.

3. A cyanide-free gold electroplating solution according to claim 1, wherein said additional elements further comprises (f) bismuth element in gold deposit is 0.01-100 ppm.

4. A cyanide-free gold electroplating solution according to claim 1 wherein weight ratio of said bismuth element (d) to said thallium element (e) is 0.6-30, and said bismuth element contained in the gold deposit is 0.01-100 ppm.

5. A cyanide-free gold electroplating solution according to claim 1, wherein a content of (d) bismuth catalyst (as bismuth element) is 35 to 140 mg/L and the content of (e) thallium catalyst (as thallium element) is 6 to 45 mg/L.

6. A cyanide-free gold electroplating solution according to claim 1, wherein (h) a weight ratio ((d+e)/(b)) to a weight of said sulfurous acid or sulfite (b) is $1.4\times10^{-4}$ to $400\times10^{-4}$.

7. A cyanide-free gold electroplating solution of claim 1, wherein said bismus catalyst is one or more of bismuth nitrate, bismuth sulfamate, bismuth phosphate, bismuth diphosphate, bismuth acetate, bismuth citrate, bismuth phosphonate, bismuth carbonate, bismuth oxide, and bismuth hydroxide, and also said thallium catalyst is one or more of thallium formate, thallium sulfate, thallium nitrate, thallium carbonate, thallium oxide, thallium bromide, thallium acetate and thallium malonate.

8. A cyanide-free gold electroplating solution according to claim 3, wherein the thallium element in said gold electrodeposit is less than 0.1 ppm.

* * * * *